US009079284B2

(12) United States Patent
Christenson et al.

(10) Patent No.: US 9,079,284 B2
(45) Date of Patent: Jul. 14, 2015

(54) AUTOMATED INSTRUMENT SHARPENING AND CLEANING SYSTEM

(76) Inventors: Marc Christenson, Round Rock, TX (US); Isaac Jones, Round Rock, TX (US)

( * ) Notice: Subject to any disclaimer, the term of this patent is extended or adjusted under 35 U.S.C. 154(b) by 711 days.

(21) Appl. No.: 13/327,536

(22) Filed: Dec. 15, 2011

(65) Prior Publication Data

US 2012/0156964 A1 Jun. 21, 2012

(51) Int. Cl.

| | |
|---|---|
| ***B24B 1/00*** | (2006.01) |
| ***B24B 51/00*** | (2006.01) |
| ***B24B 3/54*** | (2006.01) |

(52) U.S. Cl.

CPC .. *B24B 3/54* (2013.01); *B24B 51/00* (2013.01)

(58) Field of Classification Search

CPC ..... B24B 3/54; B24B 51/00; B24B 3/36; B24B 49/02

USPC ..... 451/5, 45, 10, 11, 9, 259

See application file for complete search history.

(56) References Cited

U.S. PATENT DOCUMENTS

| | | | | |
|---|---|---|---|---|
| 4,602,531 | A * | 7/1986 | Korhonen | 76/82 |
| 4,608,643 | A * | 8/1986 | Breitenstein et al. | 700/164 |
| 4,845,900 | A * | 7/1989 | Suzuki et al. | 451/5 |
| 4,869,025 | A * | 9/1989 | Hill et al. | 451/273 |
| 5,906,534 | A * | 5/1999 | Folkman et al. | 451/45 |
| 6,071,181 | A * | 6/2000 | Wightman et al. | 451/192 |
| 6,142,046 | A * | 11/2000 | Mierau et al. | 83/62.1 |
| 6,663,465 | B2 * | 12/2003 | Gross | 451/5 |
| 6,955,584 | B2 * | 10/2005 | Giurgiuman et al. | 451/5 |
| 2002/0173246 | A1 * | 11/2002 | Loth | 451/45 |
| 2011/0281503 | A1 * | 11/2011 | Knecht et al. | 451/5 |

FOREIGN PATENT DOCUMENTS

| | | | |
|---|---|---|---|
| DE | 3534291 C | * | 11/1986 |
| WO | WO 2007148878 A1 | * | 12/2007 |

OTHER PUBLICATIONS

Anderson, Charles R., Automated Instrument Sharpening and Cleaning System, Patent Cooperation Treaty Application Serial No. PCT/US2012/069387, filed Dec. 13, 2012, International Search Report and Written Opinion, dated Mar. 4, 2013.

* cited by examiner

*Primary Examiner* — Joseph J Hail
*Assistant Examiner* — Marc Carlson

(57) ABSTRACT

An automated knife sharpening and cleaning system is provided. The system comprises a container body that is configured to hold a utensil holder that is configured to releasably couple to the container body, the utensil holder configured to hold a utensil. The system further includes a drive assembly and a gripper assembly, the gripper assembly being coupled to the drive assembly and the drive assembly being configured to move the gripper assembly within the three-dimensional coordinate space of the container body. The system further includes a grinding assembly that is configured to sharpen the utensil. During operation of the system, the gripper assembly is configured to grip the utensil and remove the utensil from the utensil holder, hold the utensil within the grinding assembly during sharpening, and replace and release the utensil in the utensil holder once the sharpening is complete. Moreover, the system may clean and sanitize the utensil.

4 Claims, 30 Drawing Sheets

AUTOMATED INSTRUMENT SHARPENING AND CLEANING SYSTEM

CROSS REFERENCE TO RELATED APPLICATION

This is an original utility patent application.

BACKGROUND

1. Technical Field

This disclosure relates generally to an instrument sharpening system, and, in particular, to an automated knife sharpening and cleaning system that efficiently treats and prepares knives for use within the food-preparation industry, or other applicable industries.

2. State of the Art

The food preparation/processing industry is largely responsible for transforming raw ingredients into food or transforming food into other forms for consumption by humans. Food preparation/processing typically incorporates taking harvested yields, such as crops, or taking butchered animal products, such as beef or chicken, and using these raw resources to produce the finished goods and products that we conveniently find in our local grocer, or other food distribution facility, whether the finished products be canned goods or freshly-available items.

Principally, within the meat preparation/processing industry, but also within other applicable industries, the instruments used by meat carvers to prepare and treat any of the butchered animal products must meet certain performance and sanitation requirements and must perform to the satisfaction of the meat preparer. If not so, the instrument is of little value to the meat preparer and to the industry at large. Without top quality instruments, the efficiency of the meat preparation/processing industry is frustrated and, as a result, the time required to satisfy the required output of prepared meat is necessarily extended and profits are accordingly reduced.

Cutting knives, in particular, are perhaps the most important instrument of any of the instruments available to the meat preparer. A cutting knife that effortlessly and precisely cuts through the butchered meat products allows the meat preparer to efficiently and consistently cut the desired portions of meat required by the industry at large, the distributor, or the local butcher. Such a knife is at least clean and satisfactorily sharp. Without such a knife, the portions of meat cut by a dull knife may be messy, unsatisfactory, unattractive, and may not meet the requirements for distribution and sale to the public.

To keep a cutting knife sharp and clean, sharpeners have been invented to sharpen meat preparation knives that become dirty and dull through use. However, these conventional sharpeners usually require manual operation, which results in one knife being sharpened by the operator at any one time. In many instances, at meat preparation facilities around the world, the number of knives waiting to be sharpened is greater than the capacity of the operator to sharpen the dull knives, even when more than one sharpener is operational. The result is that many meat carvers/preparers use duller knives to prepare meat rather than a clean and sharp knife, because either a freshly cleaned and sharpened knife is unavailable or it would take too long to have their dull and dirty knife cleaned and sharpened. Consequently, by using dirty and dull knives, the quality and sanitation of prepared meat products suffers and the speed and efficiency of individual meat carvers/prepares is reduced.

In view of the above, there is a need in the meat preparation/processing industry for a knife sharpening system that is capable of efficiently and effectively sharpening, cleaning, oiling and sanitizing cutting knives to keep up with and satisfy the demands of the industry.

SUMMARY

The present disclosure relates to a knife sharpening system, and, in particular, to an automated knife sharpening and cleaning system that efficiently treats and prepares knives for use within the food-preparation industry, or other applicable industries.

A first general aspect relates to the automated knife sharpening and cleaning system having a container body, a utensil holder, the utensil holder being configured to be releasably coupled to the container body, the utensil holder being configured to hold a utensil, a drive assembly, a gripper assembly, the gripper assembly being coupled to the drive assembly, the drive assembly being configured to move the gripper assembly within the container body, and a grinding assembly, the grinding assembly being configured to sharpen the utensil, wherein the gripper assembly is configured to grip the utensil and remove the utensil from the utensil holder, hold the utensil within the grinding assembly during sharpening, and replace and release the utensil in the utensil holder once the sharpening is complete.

Another general aspect relates to the container body further comprising an internal frame, the utensil holder, the drive assembly, and the grinding assembly being coupled to the internal frame.

Another general aspect relates to the utensil holder further comprising: a base, connection means, the connection means being configured to releasably and repeatedly couple the utensil holder to the container body, a retaining member coupled to the base, and a retaining device coupled to the retaining member, wherein the retaining device is configured to releasably and repeatedly couple the utensil to the retaining member.

Another general aspect relates to the drive assembly further comprising a first-direction drive assembly that is configured to move the gripper assembly in a first direction, a second-direction drive assembly that is configured to move the gripper assembly in a first direction, and a third-direction drive assembly that is configured to move the gripper assembly in a first direction, wherein the gripper assembly is coupled to the third-direction drive assembly, the third-direction drive assembly is coupled to the second-direction drive assembly, the second-direction drive assembly is coupled to the first-direction drive assembly, and the first-direction drive assembly is coupled to an internal frame in the container body.

Another general aspect relates to the gripper assembly further comprising a gripper bracket, means for sensing the utensil, means for gripping the utensil, and means for rotating the gripper bracket between a retracted position and an extended position, wherein in the retracted position the gripper assembly is configured to remove or replace the utensil in the utensil holder and in the extended position the gripper assembly is configured to hold the utensil in the grinding assembly for sharpening of the utensil.

Another general aspect relates to the grinding assembly further comprising a mount, the mount being coupled to the container body, a grinding station, the grinding station being pivotally coupled to the mount and the grinding station having coupled thereto a grinding stone, and a motor, wherein operation of the motor causes the grinding station to pivot with respect to the mount.

Another general aspect relates to the grinding assembly further comprising a grinding wheel stage, a grinding wheel holder that is configured to hold a grinding wheel, the grinding wheel holder being slidably engaged with the grinding wheel stage, and a motor functionally coupled to the grinding wheel holder, wherein operation of the motor causes the grinding wheel holder to slide along the grinding wheel stage.

Another general aspect relates to the grinding assembly further comprising a pair of grinding wheel holders slidably engaged with the grinding wheel stage, and a motor functionally coupled to each of the grinding wheel holders of the pair, wherein operation of the motor causes the pair of grinding wheel holders to slide either closer to one another or further apart from one another along the grinding wheel stage to space the grinding wheels closer together or further apart, respectively.

Another general aspect relates to the grinding assembly further comprising means for rotating the grinding stone.

Another general aspect relates to the grinding assembly further comprising a control unit, the control unit being configured to adjust an operation of the grinding assembly, a sensor coupled to the grinding assembly, the sensor being configured to sense the profile of the utensil placed within the grinding assembly and provide feedback to the control unit.

Another general aspect relates to the grinding assembly further comprising a mount, the mount being coupled to the container body, a grinding station, the grinding station being pivotally coupled to the mount and the grinding station having coupled thereto a grinding stone, and a motor, the motor being configured to cause the grinding station to pivot with respect to the mount, wherein feedback from the sensor to the control unit allows the control unit to operate the motor to pivot the grinding station such that the grinding stone remains perpendicular to the curvature of a blade of the utensil during sharpening of the utensil.

The system of claim 1, the system further comprising means for sharpening the utensil, means for honing the utensil, and means for steeling the utensil.

The system of claim 1, the system further comprising a control unit, a water supply, a sanitizing agent, spray nozzles, and a mixer/injector, the mixer/injector being in fluidic communication with the water supply, the sanitizing agent and the spray nozzles, wherein the control unit is configured to instruct the mixer/injector to spray water from the spray nozzles onto the utensil prior to the gripper assembly gripping the utensil, and wherein the control unit is configured to instruct the mixer/injector to spray a mixture of the water and the sanitizing agent onto the utensil after the gripper assembly has released the utensil.

Another general aspect relates to the means for gripping the utensil further comprising a first gripping mechanism assembly, a second gripping mechanism assembly, an opposing gripping plate, and actuators, wherein operation of the actuators causes the first and second gripping mechanism assemblies to move toward the opposing gripping plate to grip the utensil therebetween.

Another general aspect relates to the means for rotating the gripper bracket between a retracted position and an extended position further comprising an actuator, a rack and pinion gear assembly, and a shaft, the shaft having coupled thereto the pinion gear at a center portion of the shaft and the gripper bracket at distal ends of the shaft, wherein operation of the actuators causes the rack gear to linearly displace to cause the pinion gear to rotate to pivot the gripper bracket about the shaft.

Another general aspect relates to the utensil being a knife.

Another general aspect relates to a method of renewing a utensil, the method comprising inserting a utensil in a utensil holder in a container body, gripping the utensil in a gripper assembly positioned in the container body, removing the utensil from the utensil holder by operation of the gripper assembly, moving the gripper assembly within the container body to position the utensil near a grinding assembly within the container body, sharpening the utensil with the grinding assembly, moving the gripper assembly within the container body to replace the utensil in the utensil holder.

Another general aspect of the method relates to using sensors to detect a position of the utensil in the utensil holder, communicating the sensed position to a control unit, controlling the operation of the gripper assembly from the sensed position communicated to the control unit.

Another general aspect of the method relates to using sensors to detect a position of the utensil near the grinding assembly, using sensors to detect an entire profile of a blade of the utensil, communicating the entire profile to a control unit, sharpening the blade of the utensil against a grinding stone in a grinding station in the grinding assembly, instructing the grinding station to pivot the grinding station so as to maintain a perpendicular orientation of the grinding stone with respect to the profile of the blade.

Another general aspect of the method relates to spraying heated water onto the utensil prior to removal of the utensil from the utensil holder, and spraying a mixture of water and sanitizing solution onto the utensil after replacement of the utensil in the utensil holder.

The foregoing and other features, advantages, and construction of the present disclosure will be more readily apparent and fully appreciated from the following more detailed description of the particular embodiments, taken in conjunction with the accompanying drawings.

BRIEF DESCRIPTION OF THE DRAWINGS

Some of the embodiments will be described in detail, with reference to the following figures, wherein like designations denote like members.

DETAILED DESCRIPTION OF EMBODIMENTS

A detailed description of the hereinafter described embodiments of the disclosed apparatus and method are presented herein by way of exemplification and not limitation with reference to the Figures listed above. Although certain embodiments are shown and described in detail, it should be understood that various changes and modifications may be made without departing from the scope of the appended claims. The scope of the present disclosure will in no way be limited to the number of constituting components, the materials thereof, the shapes thereof, the relative arrangement thereof, etc., and are disclosed simply as an example of embodiments of the present disclosure.

As a preface to the detailed description, it should be noted that, as used in this specification and the appended claims, the singular forms "a", "an" and "the" include plural referents, unless the context clearly dictates otherwise.

Figure 1:
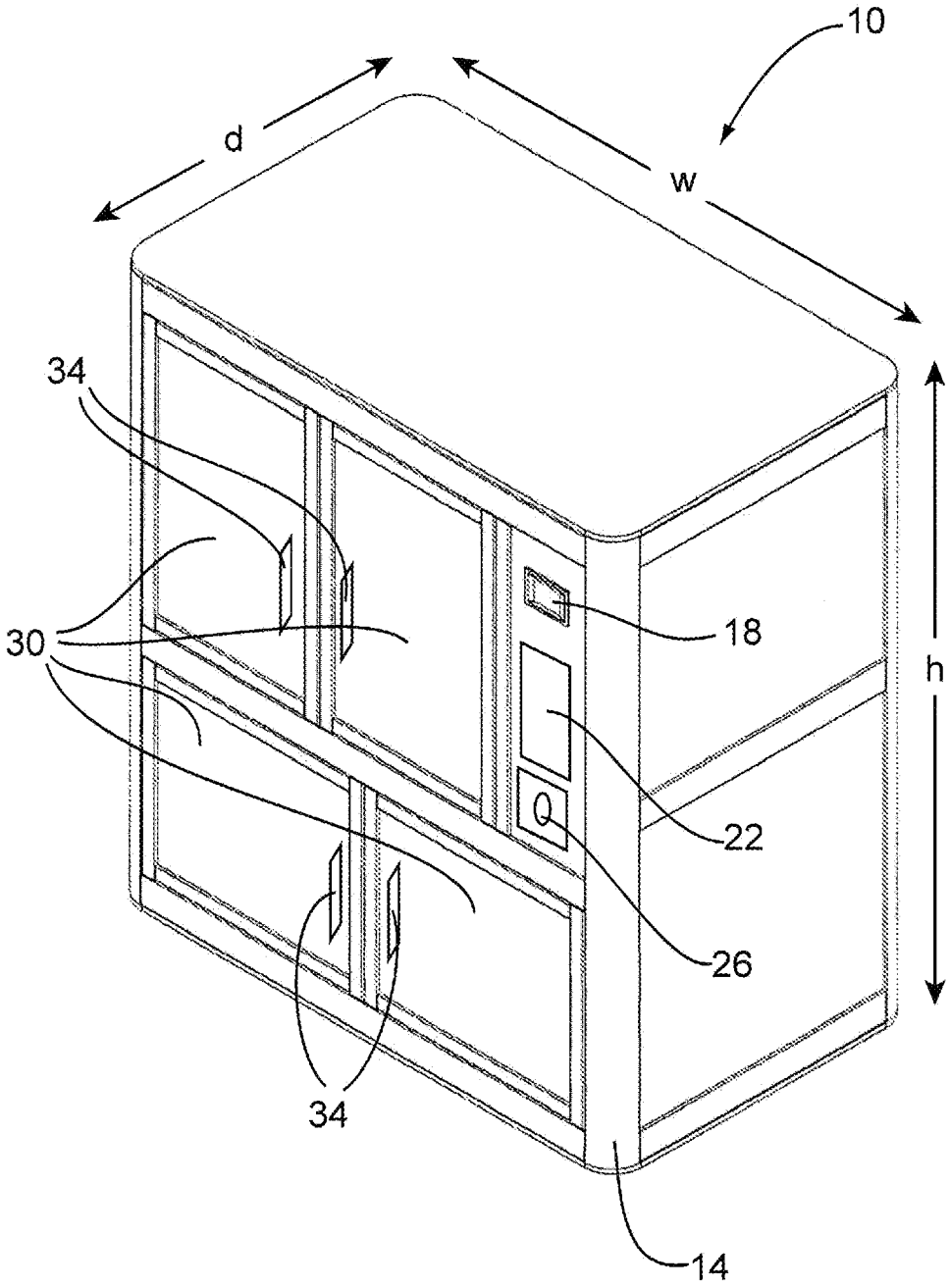
FIG. 1 is a front perspective view of a utensil sharpening and cleaning system in accordance with the present disclosure.

Referring to the drawings, FIG. 1 depicts an embodiment of an automated instrument sharpening and cleaning system 10. Embodiments of the system 10 comprise an outer frame 14 that houses and protects internal components 100 of the system 10, the internal components being configured to sharpen, clean and sanitize one or more cutting utensils 2, such as knives, scissors, shears, clippers, blades, daggers, scalpels, or other cutting devices. The outer frame 14 may be a container body that houses an internal frame 38.

For exemplary purposes within the disclosure, the Figures depict a knife as an example of a cutting utensil 2. Therefore, in reference to the Figures and hereinafter in the description, the cutting utensil will be referred to as a knife 2.

The outer frame 10 further comprises a user interface/input device 18, a display 22, an emergency shutoff 26, and panels 30. The user interface 18 allows a user to manipulate, program, start, stop, use, activate, control, or otherwise operate the system 10. The display 22 may display the current status of the system 10, such as indicating the cycle in current operation, the battery status, time-to-completion of the programmed cycle, and other system information, details, conditions, and status updates. The display 22 may further comprise an options menu, the options being selectable by the user and the menu being in functional communication with the operation of the system 10 to manipulate, program, start, stop, use, activate, control, or otherwise operate the system 10. The display 22 may work in conjunction with the user interface 18. The emergency shutoff 26 provides the user a one-touch operational input that terminates operation of the system 10 as quickly and efficiently as safely possible. The panels 30 on the system 10 are configured to open up and expose the inner components of the system 10. Handles 34 on each of the panels 30 provide the user an efficient means of opening the panels 30. The outer frame 14 may have a height h, a width w, and a depth d. The width w generally defines the orientation of a first direction, the height h generally defines the orientation of a second direction, and the depth d generally defines the orientation of the a third direction.

Figure 2:
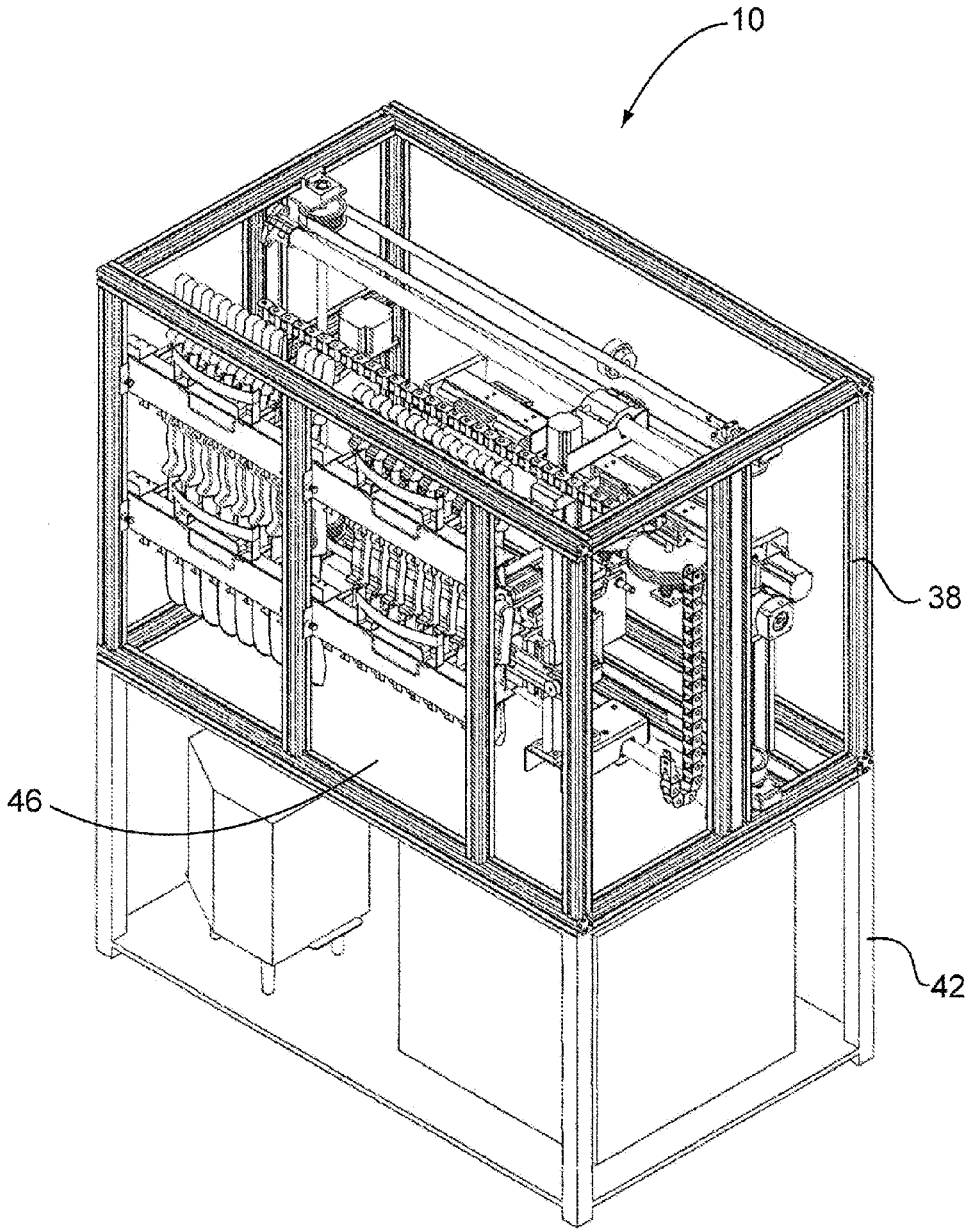
FIG. 2 is a front perspective view of the utensil sharpening and cleaning system having an outer frame removed exposing the inner moving parts in accordance with the present disclosure.
Figure 3:
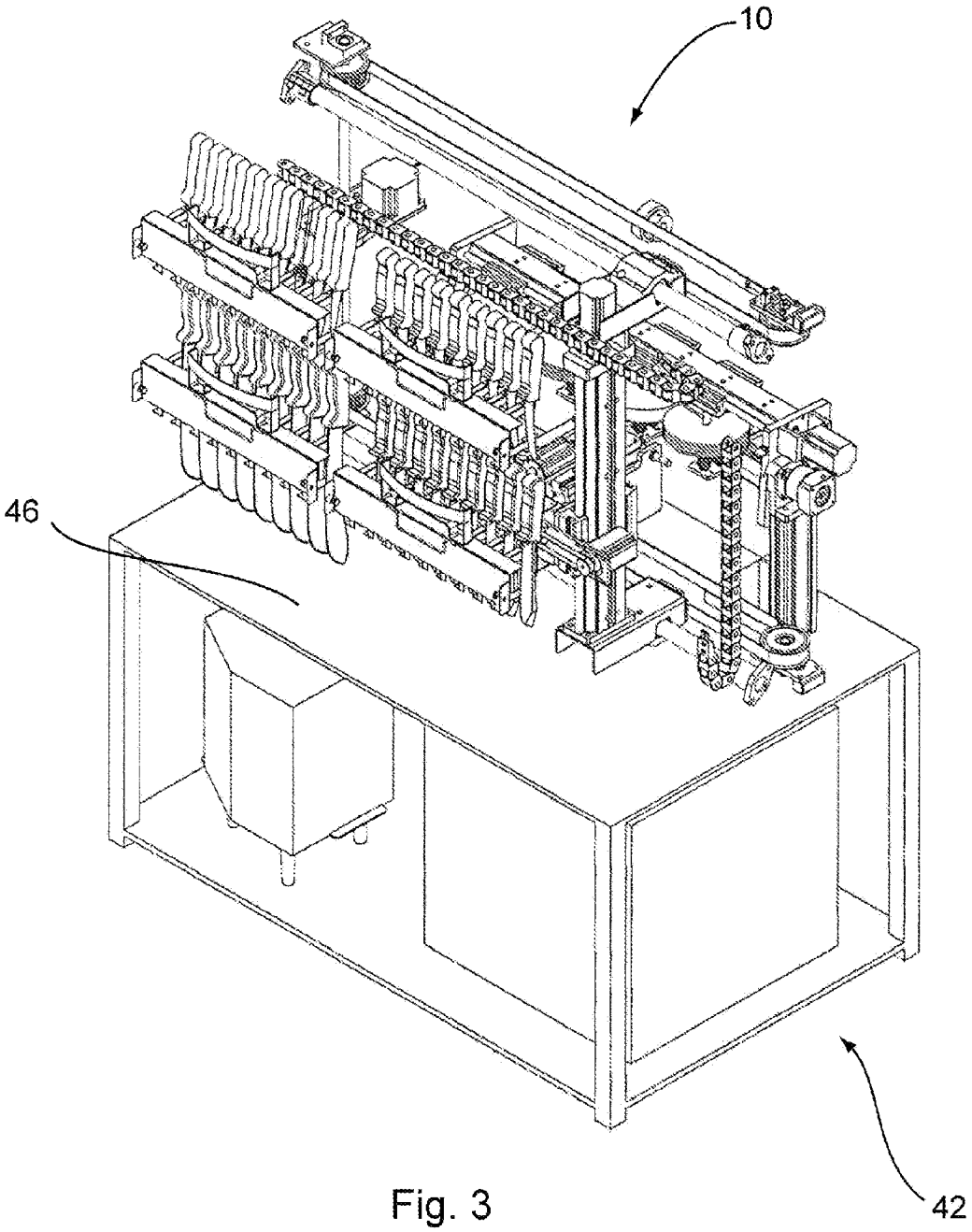
FIG. 3 is a front perspective view of the utensil sharpening and cleaning system having an outer frame and an inner frame removed exposing inner components in accordance with the present disclosure.

FIG. 2 depicts the system 10 having the outer frame 14 removed, thus exposing an inner frame 38 and a support frame 42. The inner frame 38 may comprise metal beams, or supports, that function to provide rigidity and stiffness to the system 10. The inner frame may also be comprised of other materials, such as rigid plastics or composites, as long as the inner frame 38 provides sufficient rigidity to the system 10 and allows the system 10 to perform its intended operation. Further, the internal components 100 of the system may be coupled to and supported by the inner frame 38. The inner frame 38 may further comprise the support frame 42, such that the inner frame 38 and the support frame 42 are an integral piece. Alternatively, the support frame 42 may be a separate piece that is releasably coupled to the inner frame 38. The support frame 42 further comprises a fluid collector 46, the fluid collector 46 being functionally positioned beneath the moving components 100 of the system 10. The fluid collector 46 is configured to capture, direct, and remove any fluids from the system 10 that may be utilized during operation of the system 10. The fluid collector 46 may be configured with a drain 48 that allows the fluid collected in the fluid collector 46 to drain out of the system 10. FIG. 3 depicts the system 10 having the inner frame 38 removed therefrom, showing the positional relationship between the internal components 100 and the fluid collector 46 and support frame 42.

Figure 4:
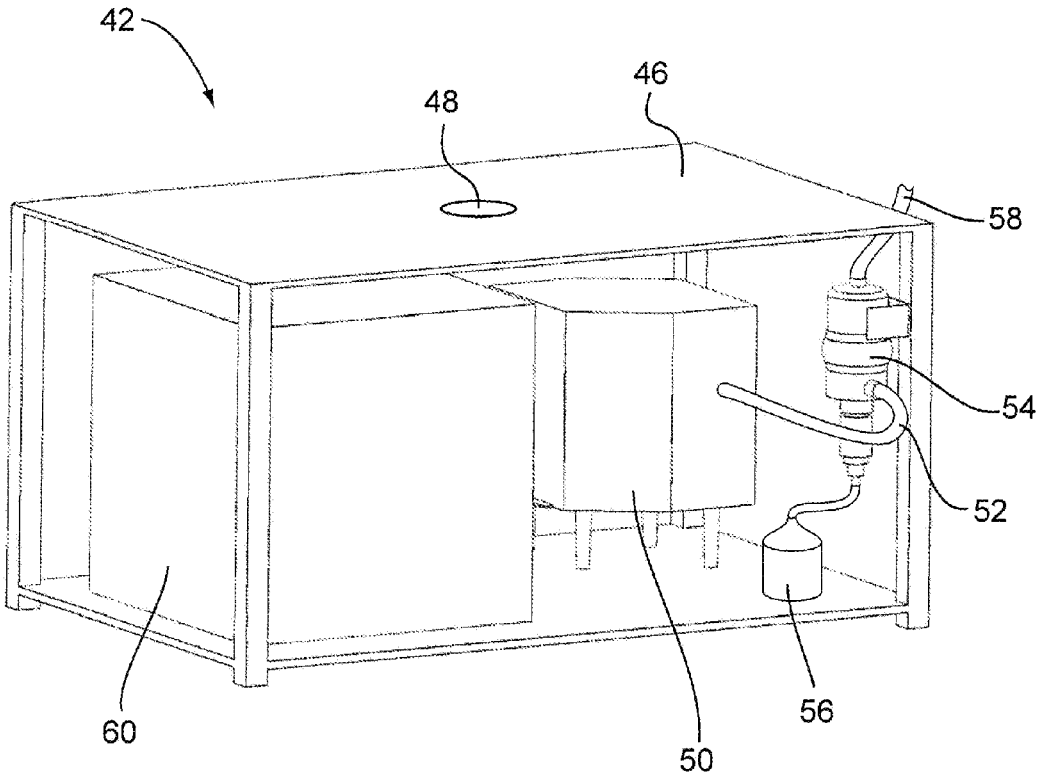
FIG. 4 is an interior view of a component of the sharpening and cleaning system in accordance with the present disclosure.
Figure 5:
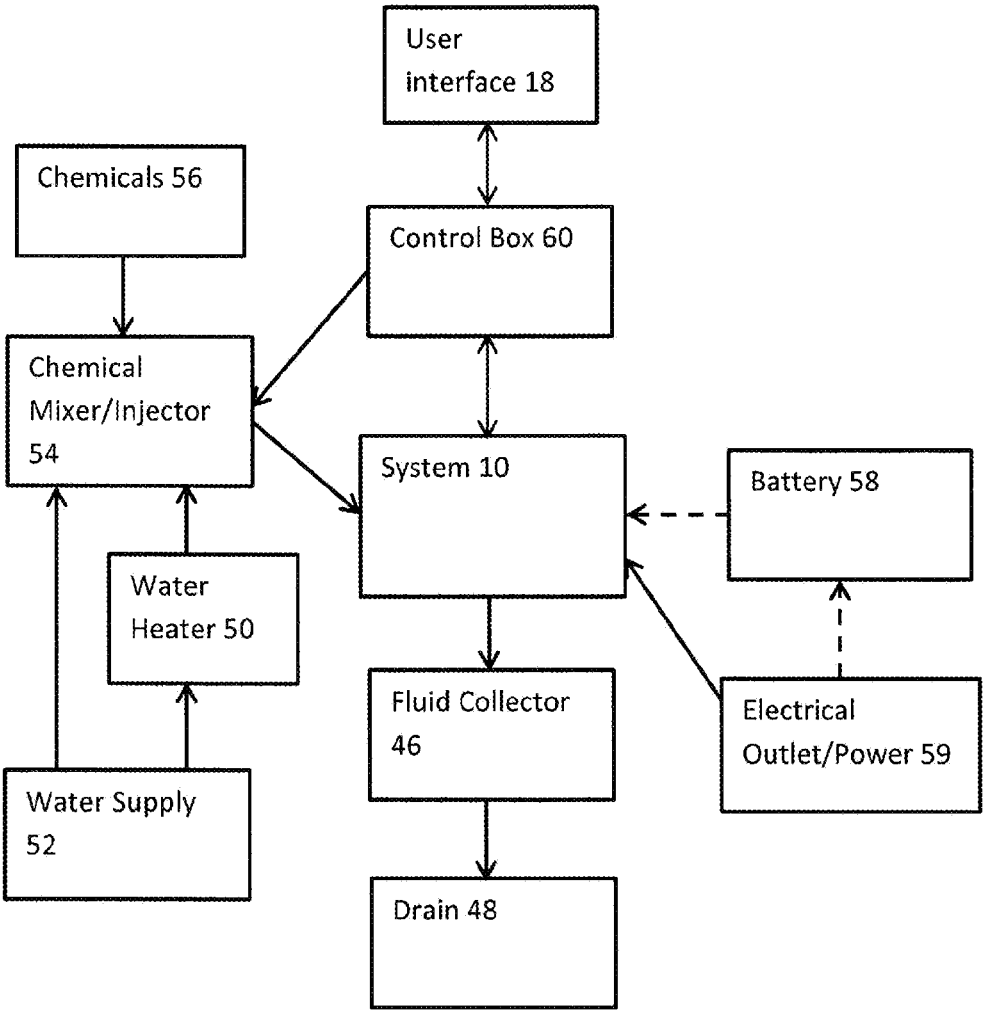
FIG. 5 is a schematic representation of the functional relationship between components of the sharpening and cleaning system in accordance with the present disclosure.

FIGS. 4 and 5 depict an embodiment of the support frame 42 and a schematic representation of several components of the system 10, some of those components being housed within the support frame 42. Embodiments of the system 10 include the support frame 42 being configured to house a control box 60, a water heater 50, a chemical mixer/injector 54, chemicals 56, and a battery 58. Embodiments of the system 10 include the water heater 50 being configured to receive incoming water from a water supply 52 and to heat the incoming water to an acceptable temperature above 180° F. The heated water can then be sent to the system 10 through the mixer/injector 54 without mixing with chemicals 56, the heated water serving to clean, or otherwise rinse, the knives 2 within the system 10. Alternatively, the heated water in the water heater 50 may be sent to the chemical mixer/injector 54 to mix with chemicals 56 prior to entering the system 10. Embodiments of the system 10 may further include the incoming water supply being directly supplied to the chemical mixer/injector 54 to mix with the chemicals 56 and enter the system 10 without passing through the water heater 50. For example, the incoming water supply may mix with the chemicals 56, such as sanitizing chemicals, within the chemical mixer/injector 54 and thereafter enter the system 10 to be sprayed onto the knives 2 to sanitize the knives 2 after the knives 2 have been sharpened, or, in the alternative, before the knives 2 are sharpened, or both. The chemicals 56 may be any number of industrial cleaning and sanitizing chemicals that are known in the art. The chemical mixer/injector 54 may be an industrial mixer/injector, such as for example, the Dosmatic® MiniDos® sold and available online. Also, any of the fluid lines within the system 10 may have placed thereon pressure valves, pressure regulators, flow control valves, filters, back flow valves, and water hammer arrestors, as needed, to ensure efficient and safe operation of the system 10. For example, flow control valves and water hammer arrestors may be placed in the fluid lines between the mixer/injector 54 and the spray valves 584 or between the water heater 50 and the spray valves 584. Further in example, a pressure regulator, a back flow preventor, and a filter may be placed in the fluid line that supplies water to the system 10.

Embodiments of the system 10 further comprise the system 10 configured to draw electric power from an external electric power source 59, such as a 110 V outlet or a 220 V outlet. However, in the absence of the external electric power source 59, the system 10 can still be operated by battery power, a battery 58 being encased within the system 10. The battery 58 may also be rechargeable, such that while the system 10 operates on the external electric power source 59, the rechargeable battery 58 charges and then maintains its charge, so that in the event the electric power to the system 10 through the external power source 59 is interrupted, the rechargeable battery 58 automatically provides power to the system 10 to allow the system 10 to complete its assigned function during the power outage of the external power source 59. Alternatively, the user may select to force the system 10 to operate from either the external power source 59 or the battery 58, as desired. The use of the battery 58 is shown in dashed lines in FIG. 5 to indicate that battery power may be an alternative power source to the external power source 59.

The control box 60 may further comprise a computer system, including, but not limited to, a processor (CPU) 62, an internal storage unit 66, random access memory (RAM) 68, software 70, alternative inputs 72 for a keyboard or mouse or other input device, a USB drive 74, a multi card reader 76, a flash drive 78, a motherboard 80, a video card 82, a sound card 84, and a speaker 86. The computer system herein described is configured to control the operational aspects of the system 10. For example, the software 70 may be a computer program that is developed and configured to operate the system 10 according to its intended operation, as described herein. Further in example, the system 10, and in particular the system software 70, can run on a National Instruments cRIO controller, which provides a flexible real-time processing platform able to handle multi-axis coordinated motion and high speed I/O.

Figure 6:
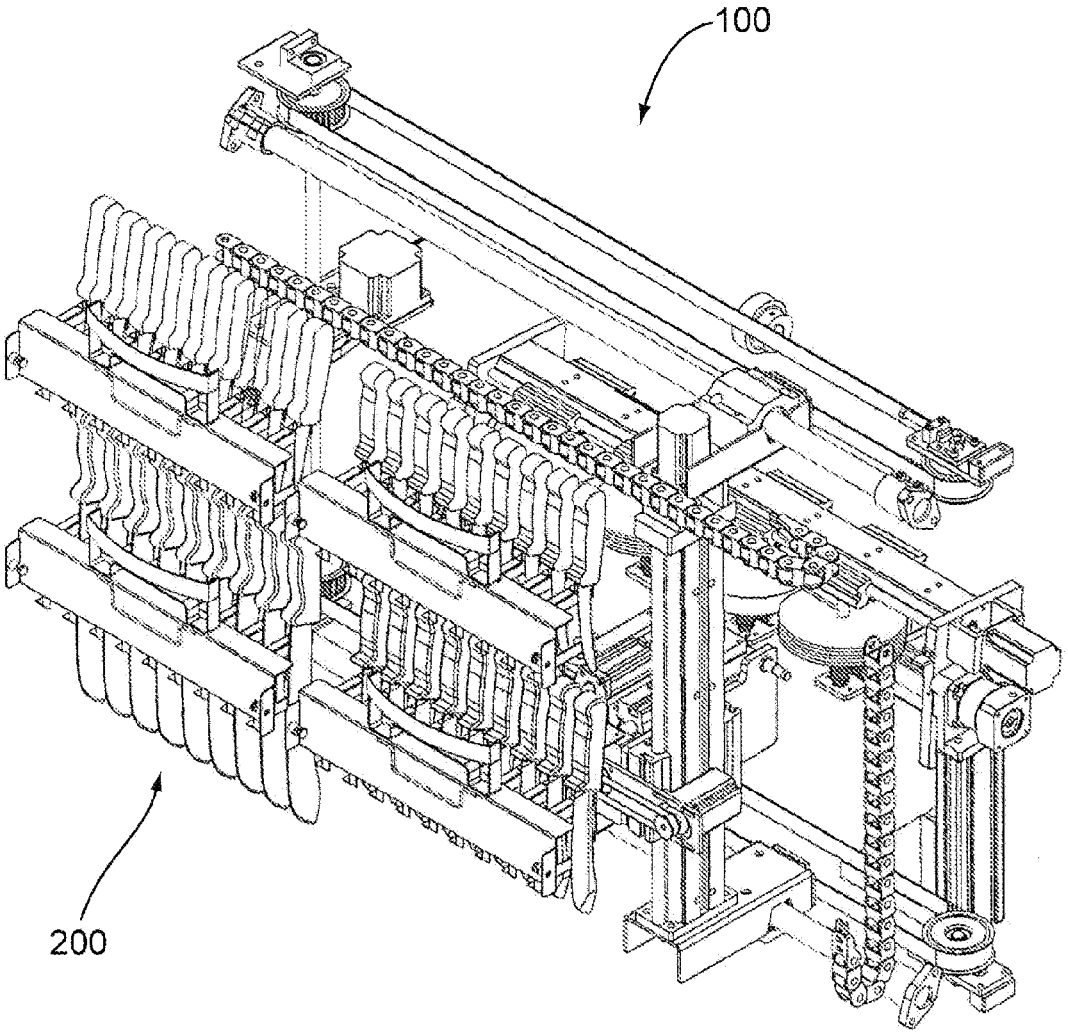
FIG. 6 is a front perspective view of internal parts of the utensil sharpening and cleaning system in accordance with the present disclosure.

FIG. 6 depicts the internal components 100 of the system 10. Embodiments of the system 10 include the internal components 100 comprising a knife holder tray 200, a first-direction drive assembly 300, a second-direction drive assembly 400, a third-direction drive assembly 500, a gripper assembly 600, and a grinder assembly 700, each to be described in greater detail below.

Figure 7:
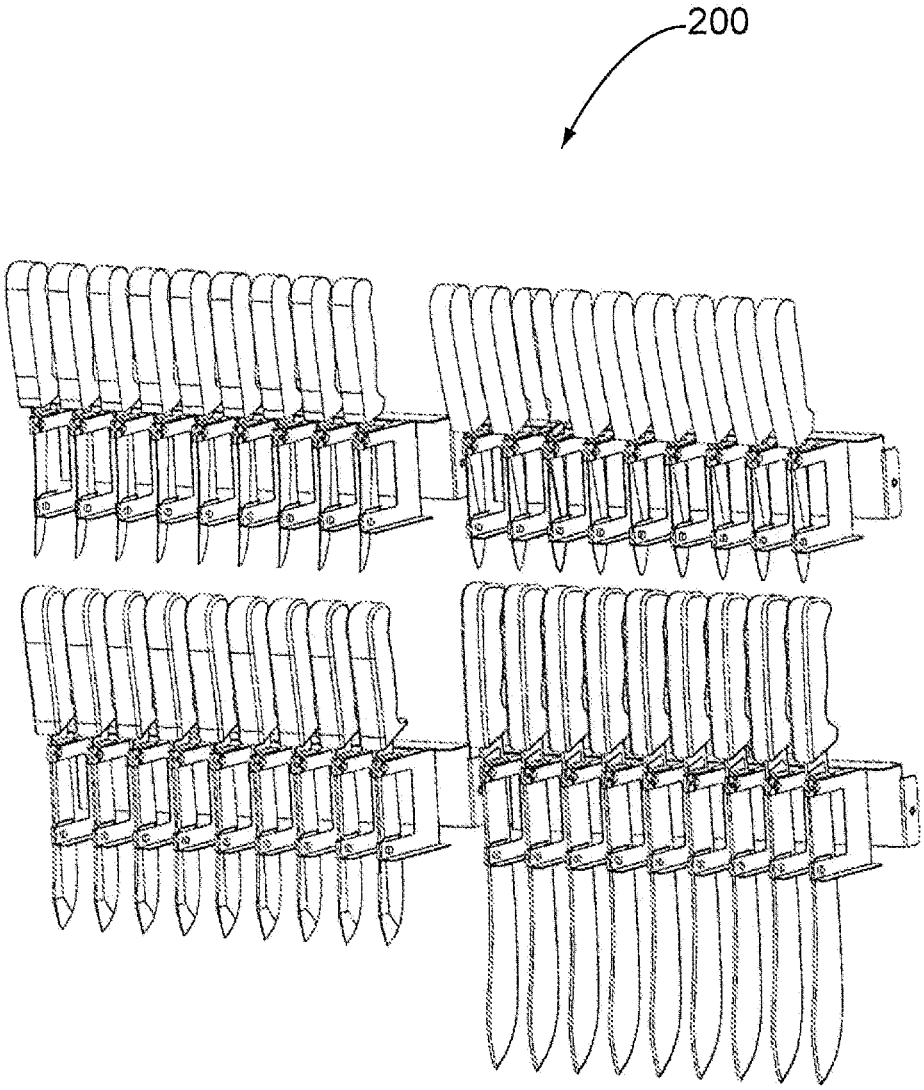
FIG. 7 is a front perspective view of utensil holding components of the sharpening and cleaning system in accordance with the present disclosure.

FIG. 7 depicts a plurality of knife holder trays 200 as they might appear within the system 10, each knife holder tray 200 being configured to hold a particularly-shaped knife 2. However, in the alternative, each knife holder tray 200 is also configured to hold variously-shaped knives 2.

Figure 8:
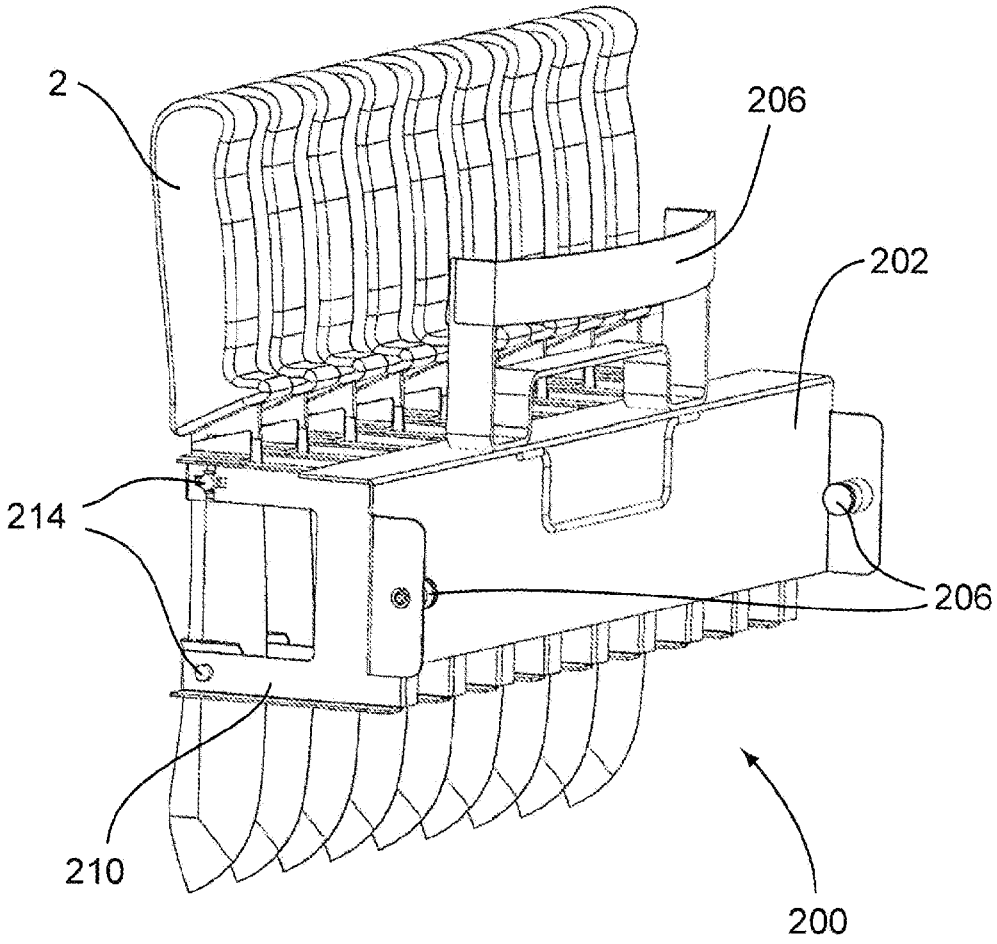
FIG. 8 is a rear perspective view of one of the utensil holding components of the sharpening and cleaning system in accordance with the present disclosure.
Figure 9:
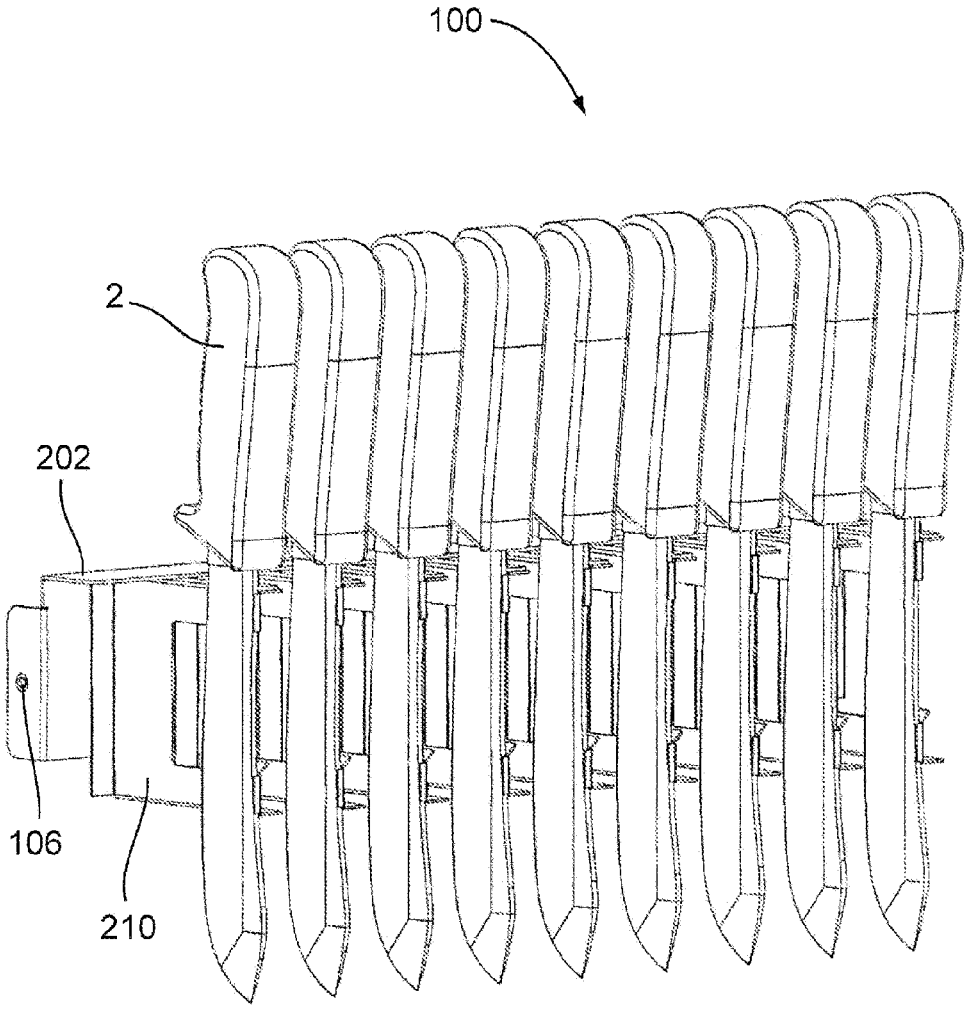
FIG. 9 is a front perspective view of one of the utensil holding components of the sharpening and cleaning system in accordance with the present disclosure.
Figure 10:
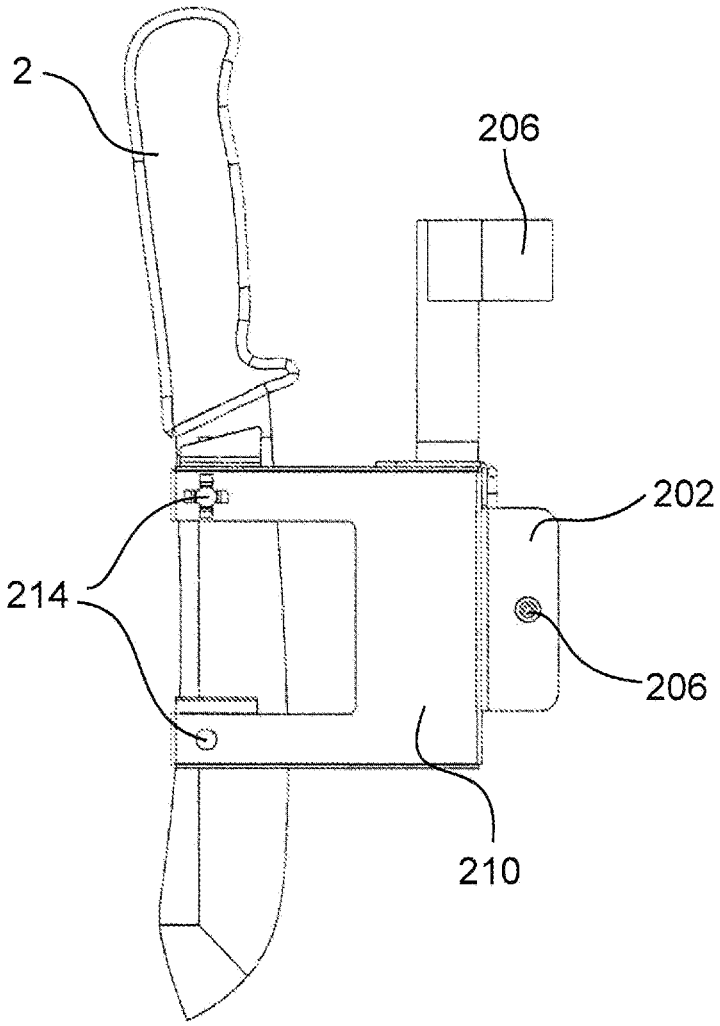
FIG. 10 is a side view of one of the utensil holding components of the sharpening and cleaning system in accordance with the present disclosure.
Figure 11:
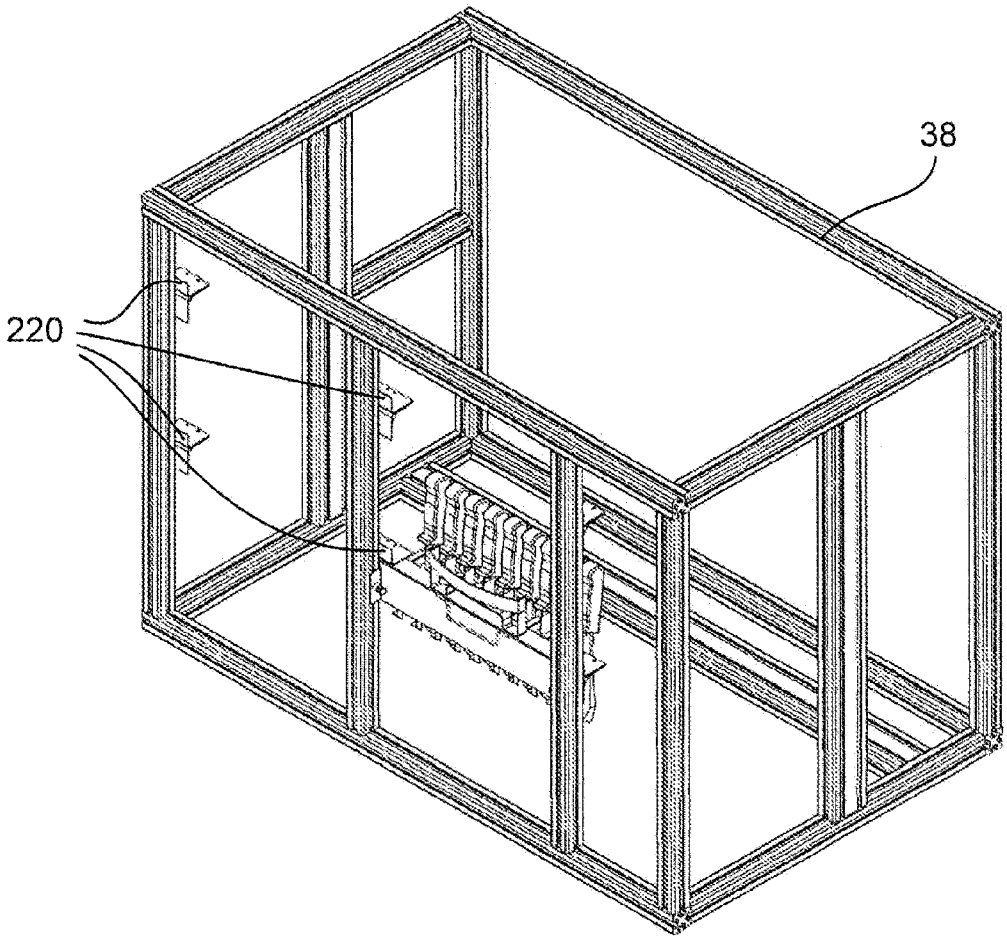
FIG. 11 is a perspective view of one of the utensil holding components within the inner frame of the sharpening and cleaning system in accordance with the present disclosure.

FIGS. 8-10 depict a knife holder tray 200 having a base 202. Coupled, or otherwise connected to the base 202, the knife holder tray 200 further comprises a handle 206 that facilitates the grip of the user on the tray 200 and provides for more efficient insertion and removal of the tray 200 from the system 10 through the open panel 30 in the exterior frame 14. The knife holder tray 200 further comprises connection means 206, such as, for example, spring plungers, that are configured to allow each individual knife holder tray 200 to releasably and repeatedly couple to the inner frame 38 or to a knife tray retaining bracket 220 (FIG. 11) within the system 10. The knife holder tray 200 further comprises one or more retaining members 210 that are configured to hold a knife 2. Each of the retaining members 210 may further comprise one or more retaining devices 214, such as magnets, clips, pins, clasps, or other like fastening devices, that provide for temporary and secure retention of a knife 2 therein or thereon. For example, magnets may be utilized as the retaining device 214 to magnetically secure a knife 2 to the tray 200 by its blade, the magnets allowing the blade of each knife 2 to reside on only one side of a respective retaining member 210 so as to permit ease of removal therefrom and attachment thereto. FIG. 11 depicts a tray 200 positioned within the internal frame 38 of the system 10, as it might appear during operation of the system 10. Embodiments of the tray 200 include the knives 2 being oriented in the tray 200, such that the spine of the blade is exposed to the gripper assembly 600. Moreover, by configuring the tray 200 to orient the knives 2 so that the spine is exposed likewise results in the blade of the knife being directed inward within the tray 200 to conceal, or otherwise shelter, the blade and provide added safety for the user. Also, the tray 200 may be configured to be positioned just inside the panel 30 to provide for easy insertion and removal of the tray 200 from the system 10 and to orient the knives 2 so that they are available to be grabbed and moved within the system 10 by the gripper assembly 600, to be described below. The system 10 is configured to detect whether a tray 200 is placed within the system 10 and communicates the presence, or lack thereof, of the tray 200 to the control box 60, such that the control box 60 may direct the gripper assembly 600 and the sensor 608 to search or not search for knives 2, as the case may be.

Figure 12:
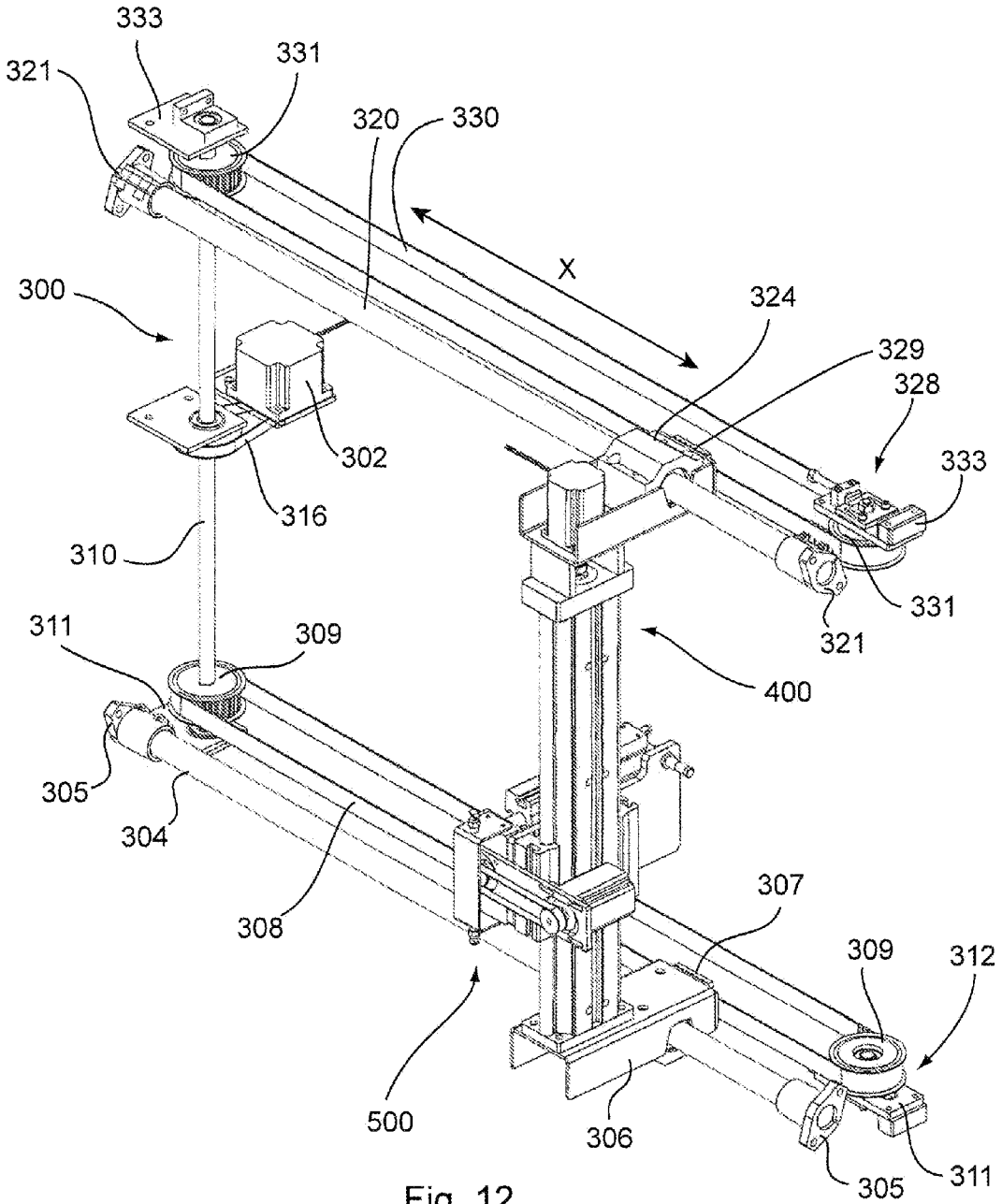
FIG. 12 is a front perspective view of displacement components of the sharpening and cleaning system in accordance with the present disclosure.

FIG. 12 depicts the first-direction drive assembly 300, the second-direction drive assembly 400, and the third-direction drive assembly 500 according to embodiments of the present disclosure. The first-direction drive assembly 300, the second-direction drive assembly 400, and the third-direction drive assembly 500 may comprise a drive assembly by which the gripper assembly 600 moves in a 3-D coordinate space within the system 10. Further, the third-direction drive assembly 500 may be mounted to the second-direction drive assembly 400 which in turn may be mounted to the first-direction drive assembly 300. Accordingly, the first-direction drive assembly 300 may be the means by which the second-direction drive assembly 400, the third-direction drive assembly 500, and the gripper assembly 600 move in the first direction W, as indicated by the arrows. Further, the second-direction drive assembly 400 may be the means by which the third-direction drive assembly 500 and the gripper assembly 600 move in the second direction. Yet further, the third-direction drive assembly 500 may be a portion of the means by which the gripper assembly 600 moves in the third direction.

The first-direction drive assembly 300 may comprise a motor 302 that drives a drive belt 316 that drives a pulley coupled to a drive shaft 310 to spin the shaft 310 about its axis. The motor 302 may be an electric motor. The upper and lower distal ends of the shaft 310 may be coupled to and retained by an upper brace 333 and a lower brace 311, respectively, the braces 311 and 333 being coupled to the interior frame 38 to hold the braces 311 and 333 in place and to thus hold the drive shaft in place 310. The drive shaft 310 may have an upper pulley 331 and a lower pulley 309 positioned near an upper end and a lower end of the shaft 310, respectively. The drive shaft 310 drives the rotational movement of the pulleys 331 and 309. The upper pulley 331 is configured to receive and engage an upper stage belt 330. On the opposing side of the upper stage belt 330, a second upper pulley 331 is coupled to a second upper brace 333 that is also coupled to the inner frame 38. The lower pulley 309 is likewise configured to receive and engage a lower stage belt 308. On the opposing side of the lower stage belt 308, a second lower pulley 309 is coupled to a second lower brace 311 that is also coupled to the inner frame 38. Thus, as the motor 302 drives the drive shaft 310, the drive shaft 310 drives the pulleys 309 and 331 to drive both the lower and upper stage belts 308 and 320.

The first-direction drive assembly 300 may further comprise a lower stage shaft 304 and an upper stage shaft 320 upon which movement along the first direction X is provided. Each of the lower stage shaft 304 and the upper stage shaft 320 may have provided thereon coupling ends 321, which are configured to couple the lower and upper stage shafts 304 and 320 to the inner frame 38 to hold the lower and upper stage shafts 304 and 320 in place. Mounted to the lower and upper stage shafts 304 and 320 are a lower stage bracket 306 and an upper stage bracket 324, respectively. The lower stage bracket 306 and an upper stage bracket 324 are configured to slide, or otherwise displace, along the axial orientation of the lower and upper stage shafts 304 and 320, respectively. Specifically, the upper stage bracket 324 further comprises a stage belt interface 329 that engages the upper stage bracket 324 with the upper stage belt 330. Accordingly, as the upper stage belt 330 is driven in the direction X between the upper pulleys 331 by the axial rotation of the drive shaft 310, the stage belt interface 329 engages the upper stage bracket 324 and causes the upper stage bracket 324 to displace along the axial direction of the upper stage shaft 320. Further, the lower stage bracket 306 further comprises a stage belt interface 307 that engages the lower stage bracket 306 with the lower stage belt 308. Accordingly, as the lower stage belt 308 is driven in the direction X between the lower pulleys 309 by the axial rotation of the drive shaft 310, the stage belt interface 307 engages the lower stage bracket 306 and causes the lower stage bracket 306 to displace along the axial direction of the lower stage shaft 304. Embodiments of the system 10 further include the first-direction drive assembly 300 comprising more than one drive motor 302 or comprising only one stage shaft and accompanying stage belt and stage bracket.

As depicted in FIG. 12, embodiment of the system 10 further comprise the second-direction drive assembly 400 and the third-direction drive assembly 500 being functionally mounted to the first-direction drive assembly 300, such that movement of the first-direction drive assembly 300 along the first direction X also provides movement of the second-direction drive assembly 400 and the third-direction drive assembly 500 along the first direction X.

Figure 13:
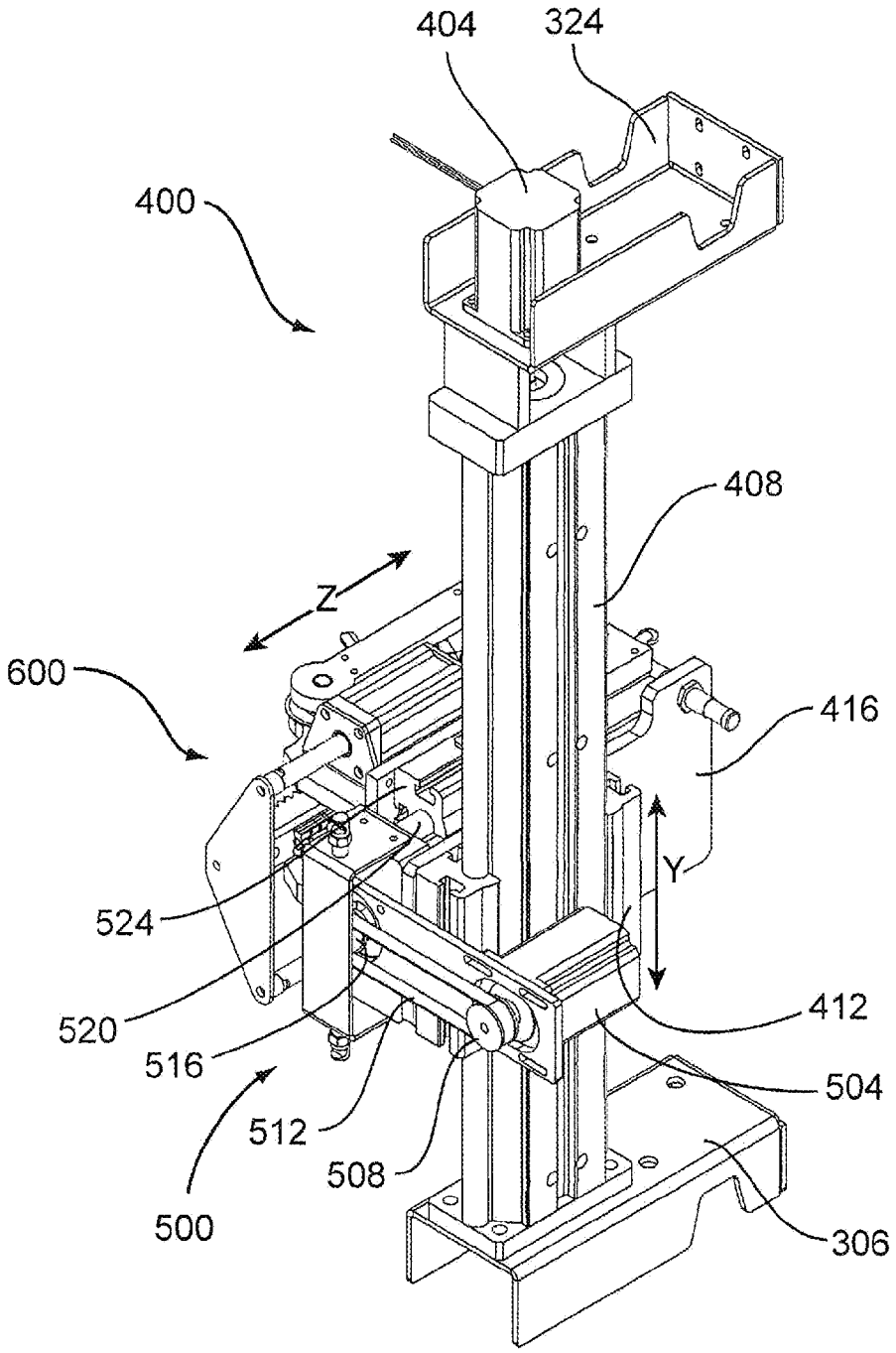
FIG. 13 is a front perspective view of displacement components of the sharpening and cleaning system in accordance with the present disclosure.
Figure 14:
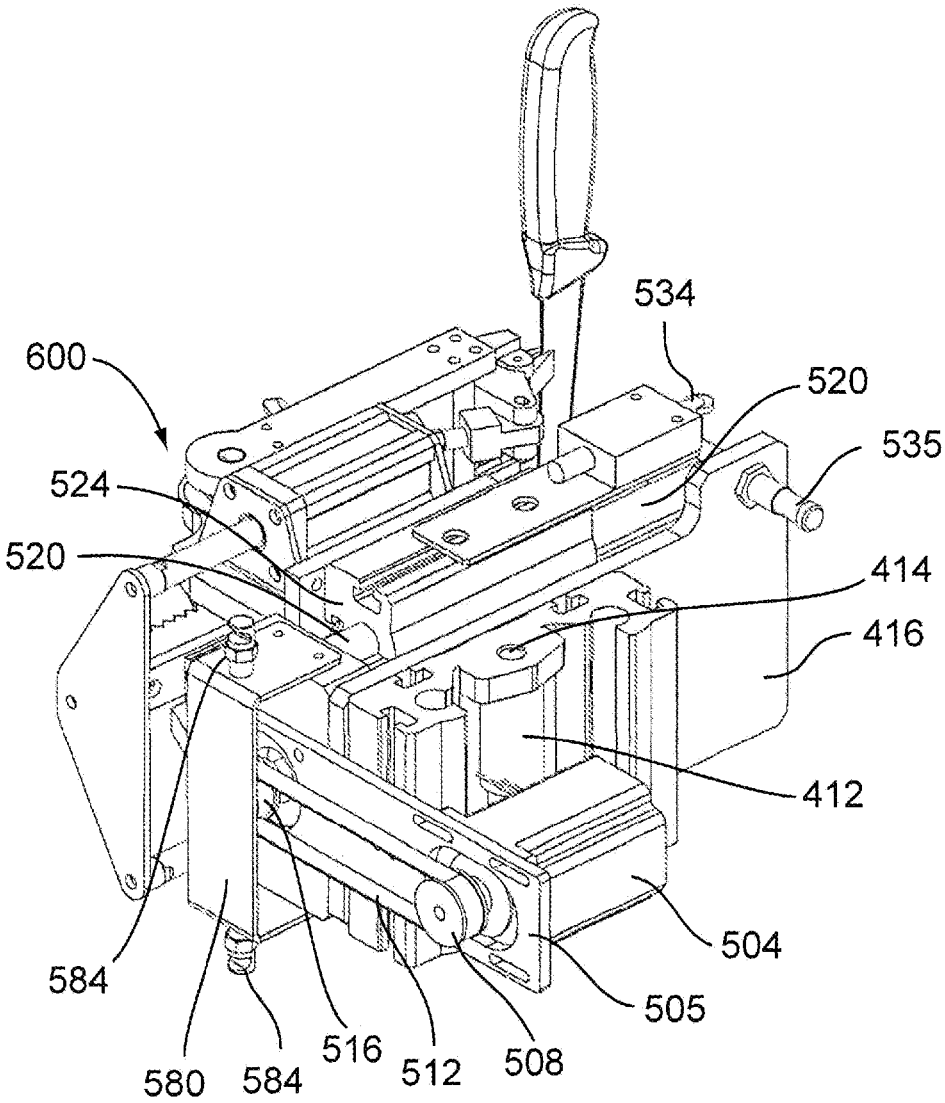
FIG. 14 is a front perspective view of displacement components of the sharpening and cleaning system in accordance with the present disclosure.
Figure 15:
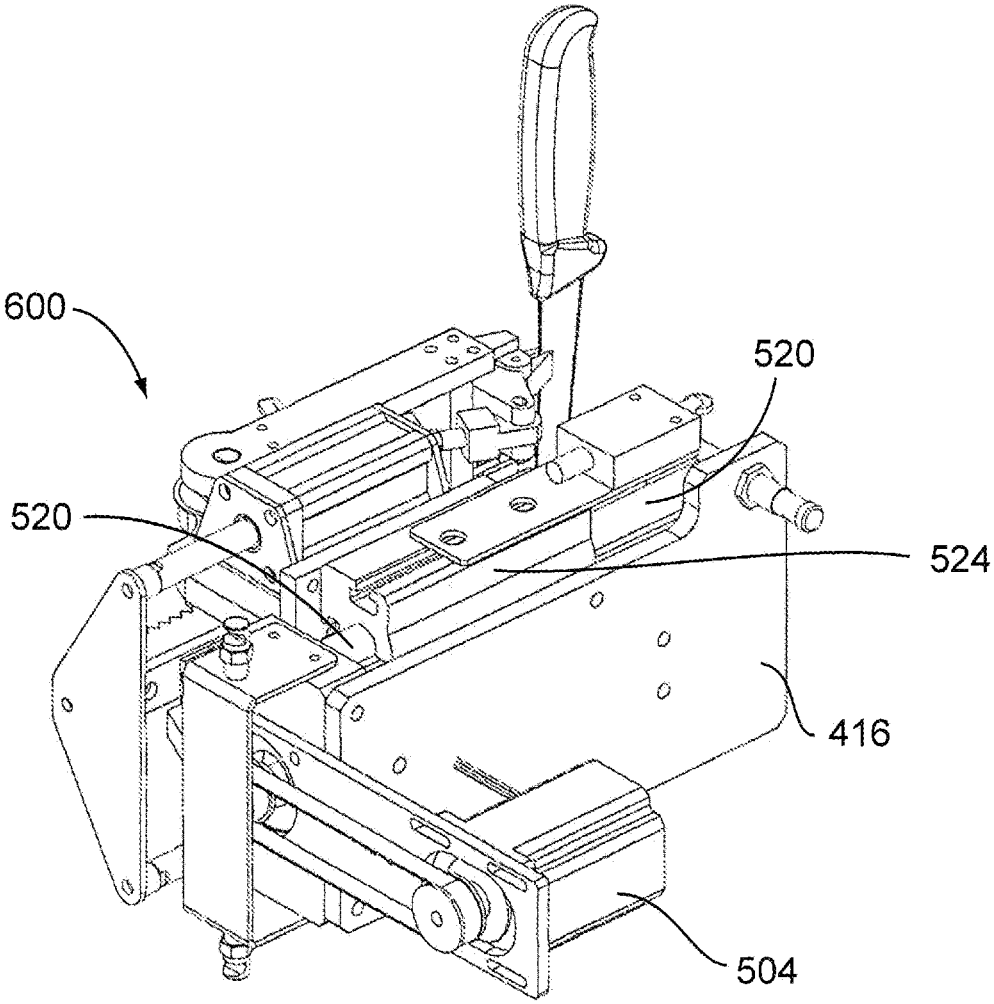
FIG. 15 is a front perspective view of displacement components of the sharpening and cleaning system in accordance with the present disclosure.

FIG. 13 depicts the second-direction drive assembly 400, the third-direction drive assembly 500, and the gripper assembly 600. Embodiments of the system 10 include the second-direction drive assembly 400 further comprising a motor 404, a stage shaft 408, and a carriage 412. The motor 404 may be an electric motor and may be mounted such that the motor 404 may provide displacement between the stage shaft 408 and the carriage 412. For example, the motor 404 may provide bi-directional rotational displacement of a shaft 405 that extends from the motor 404 down into the stage shaft 408 until the shaft 405 engages the carriage 412. Rotation of the shaft 405 causes the carriage 412 to displace along the length of the stage shaft 408 or in the second direction Y, as shown by the arrows in FIG. 13. For example, embodiments of the shaft 405 may provide that the shaft 405 is threaded to engage the corresponding threads of an drive-shaft interface 414, as depicted in FIG. 14 (which displays the stage shaft 408 removed to display the carriage 412) to cause the carriage 412 to transition in either direction along the length of the stage shaft 408 in the second direction Y. Other engagement means between the shaft 405 and the carriage 412, such as worm gears, helical gears, other gearing means, belts and pulleys, or chains may be employed to cause the carriage 412 to transition in either direction along the length of the stage shaft 408 in the second direction Y.

FIGS. 15-18 depict the third-direction drive assembly 500 and the gripper assembly 600. Embodiments of the system 10 include the third-direction drive assembly 500 further comprising a motor 504, which may be electric, a pulley 508 coupled to the bidirectional rotational displacement provided by the motor 504, a drive belt 512 coupled between the pulley 508 and another pulley 516, the pulley 516 being coupled to a third-direction stage 520. Accordingly, the bidirectional rotational displacement created by the motor 504 is transferred from the motor 504 to the pulley 508 to the belt 512 to the another pulley 516. Similarly to the operation of the shaft 405 described above, the pulley 516 is coupled to a drive shaft 528 (FIGS. 16 and 17) that enters the third-direction stage 520 and engages a drive-shaft interface 530 (FIG. 18) positioned in a carriage 524. The engagement between the drive shaft 528 and the drive-shaft interface 530 causes the carriage to displace along the length of the third-direction stage 520.

Embodiments of the system 10 include an interface plate 416 being functionally positioned between the carriage 412 and the third-direction stage 520, as depicted in FIGS. 14-17. A backside of the carriage 412 is coupled to the interface plate 416 on a side thereof and a front side of the third-direction stage 520 is coupled to the interface plate 416 on an opposing side thereof, such that as the carriage 412 transitions in the second direction Y the third-direction drive assembly 500 also transitions in the second direction Y. The interface plate 416 is also configured to hold and secure the third-direction stage 520 in its place, thus allowing the third-direction carriage 524 to transition in a third direction Z, as shown in FIG. 13, along the third-direction stage 520, as described above. A sensor 535 may be provided on the interface plate 416, the sensor 535 being configured to indicate the position of the gripper assembly 600 in the three-dimensional space within the system 10 upon start-up of the system 10. Additionally, other sensors similar to sensor 535 may be positioned on the system 10 to be utilized by the system 10 to provide positional feedback to the control box 60 (control unit) so that the control box can know where the gripper assembly 600 is located in the system 10, and thus where the knife 2 is located in the system 10. The sensors, including sensor 535, may be digital sensors or laser sensors and may be configured to measure positional location with the system 10 and communicate that position to the control box 60 so that the control box 60 may use the position information to drive the gripper assembly 600 and the knife 2 to the proper location within the system 10 according to the operational state of the system 10. The sensors, including sensor 535, may be home sensors, limit sensors, and may include a motion limit switch. The sensors, including sensor 535, may be configured to provide a home position of the component upon which the sensor is coupled upon start-up of the system 10 or may provide limits to the directional movement of the system 10. These positional inputs and limits can be communicated to the control box 60 and the control box 60 can thereafter direct future movement of the components of the system 10. One or more sensors may be positioned on each of the first-direction drive assembly 300, the second-direction drive assembly 400, and the third-direction drive assembly 500.

Embodiments of the system 10 include the third-direction drive assembly 500 further comprising a spray nozzle bracket 580 and a spray nozzle 584 coupled thereto. Alternatively, the spray nozzle 584 may be positioned on any component of the third-direction drive assembly 500, so long as the spray nozzle 584 may be oriented toward the front of the system 10. The spray nozzle 584 may be configured to discharge water, chemicals, or a combination of both provided by one of the water heater 50 or the chemical mixer/injector 54. As such, the spray nozzle 584 is oriented in the direction of the trays 200 in their stored position on the inner frame 38. In this way, the system 10 may move the first-direction drive assembly 300, the second-direction drive assembly 400, and the third-direction drive assembly 500 to move the spray nozzle 584 to each of the knives 2 in the trays 200 to spray, clean, or sanitize each of the knives 2, as desired. One or more spray nozzles 584 may be provided on the spray nozzle bracket 580, or alternatively on another component of the third-direction drive assembly 500. Embodiments of the system 10 may further include the third-direction drive assembly 500 further comprising a grinding stone touch plate sensor 534 positioned thereon. The sensor may be a digital sensor. The sensor 534 may be configured to be able to touch, or otherwise sense, the grinding stones 724 and 732 that are positioned on the grinding assembly 700, to measure the diameter of each of the grinding stones 724 and 732 to provide real-time input to the control box 60 regarding the wear, size, position, or other physical parameter of any one of the grinding stones 724 and 732. Thus, by providing real-time input the control box 60 can adjust the operation of the system 10 accordingly and specifically the position of the gripper mechanism 600 that holds the knife 2.

Figure 16:
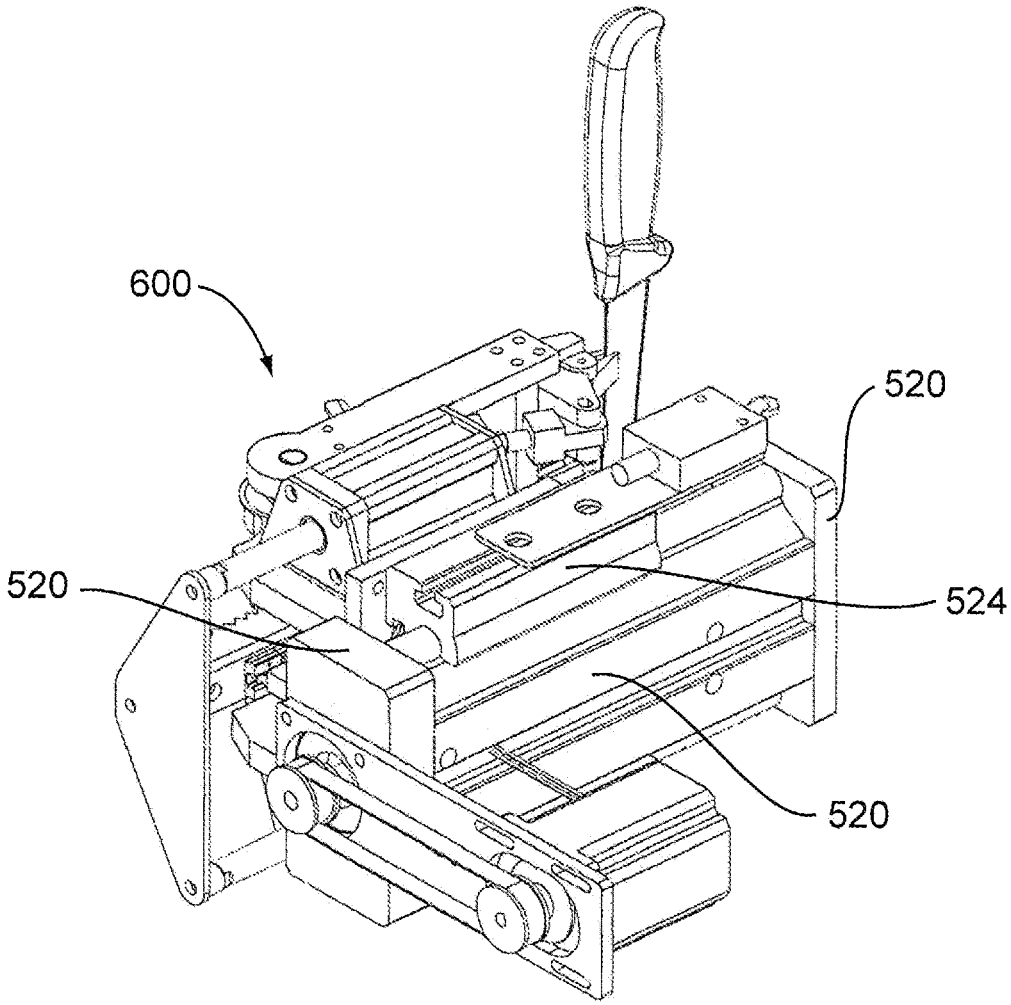
FIG. 16 is a front perspective view of displacement components of the sharpening and cleaning system in accordance with the present disclosure.
Figure 17:
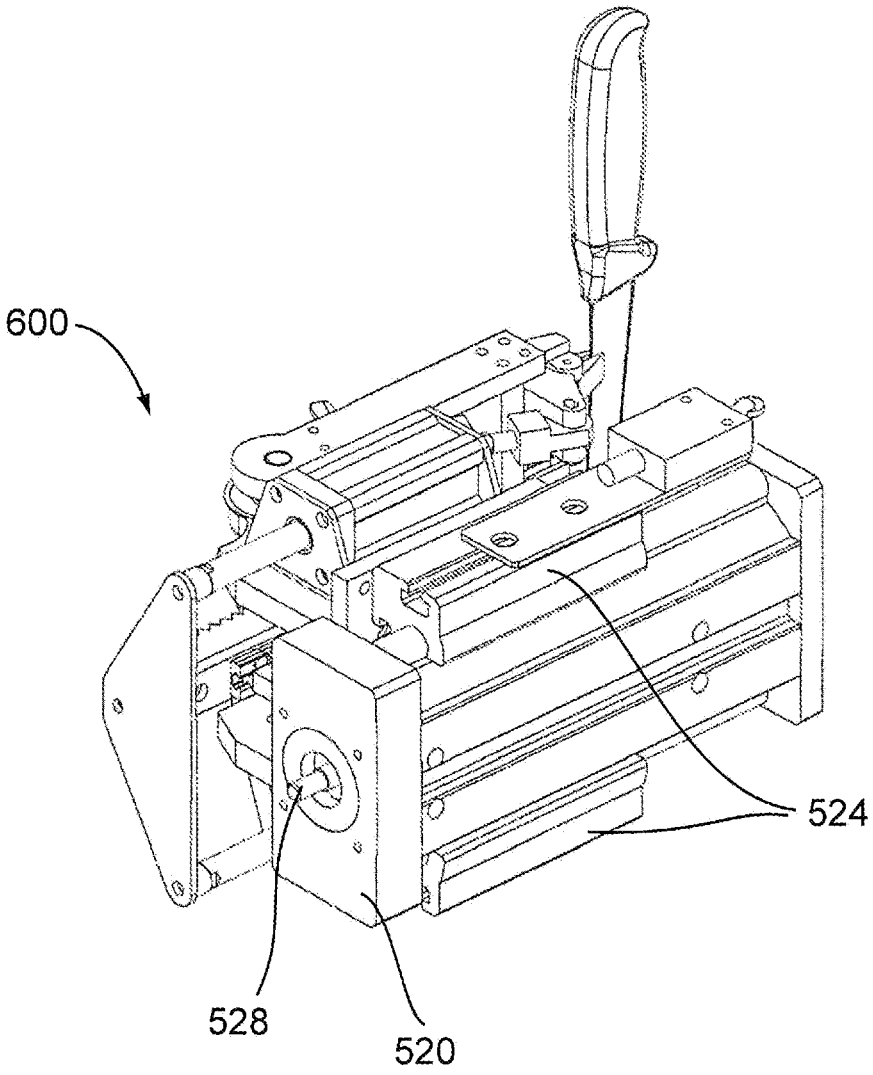
FIG. 17 is a front perspective view of displacement components of the sharpening and cleaning system in accordance with the present disclosure.
Figure 18:
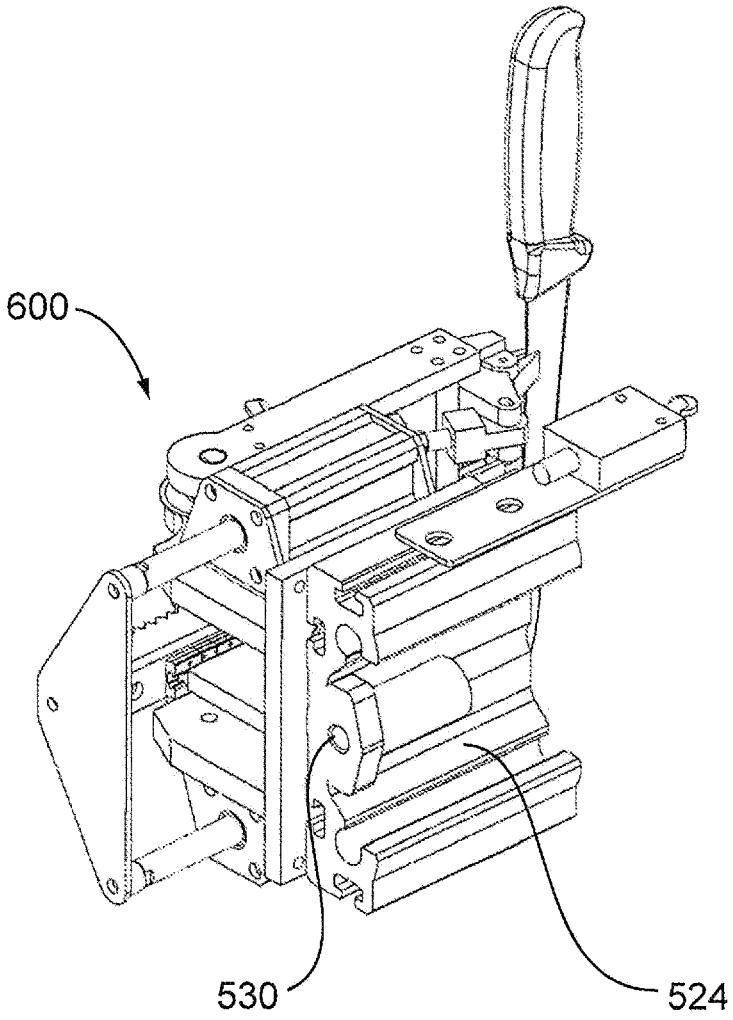
FIG. 18 is a front perspective view of displacement components of the sharpening and cleaning system in accordance with the present disclosure.
Figure 19:
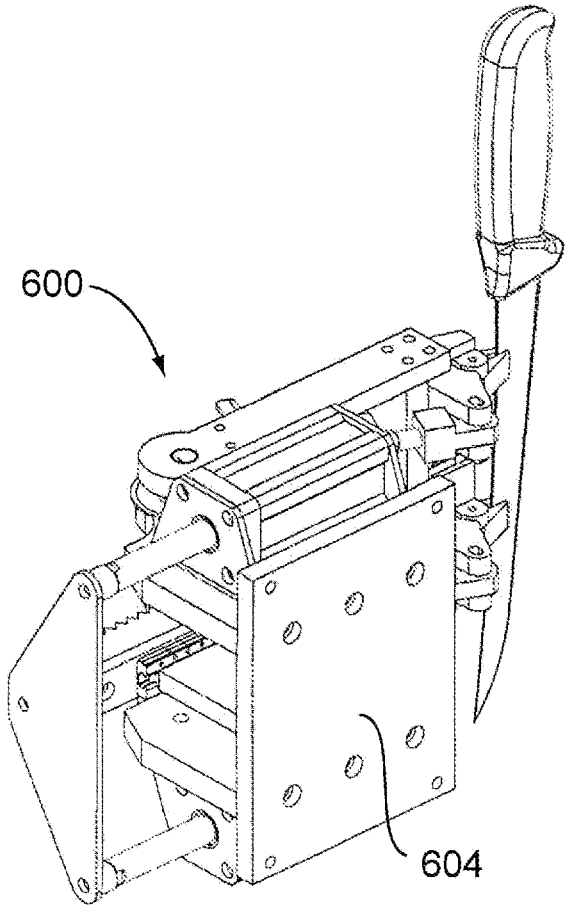
FIG. 19 is a front perspective view of a gripper assembly of the sharpening and cleaning system in accordance with the present disclosure.

FIG. 16 depicts the third-directional drive assembly 500 with the interface plate 416 being removed therefrom, thus exposing the third-direction stage 520. FIG. 17 depicts the third-directional drive assembly 500 with the motor 504, the pulleys 508 and 516, and the belt 512 being removed therefrom, thus exposing the drive shaft 528. FIG. 18 depicts the third-directional drive assembly 500 with the third-direction stage 520 being removed, thus exposing the third-direction carriage 524, including the drive-shaft interface 530. As mentioned above, the engagement between the drive shaft 528 driven indirectly by the motor 504 and the drive-shaft interface 530 causes the carriage 524 to transition in the third direction Z along the third-direction stage 520. For example, similarly to the embodiments of the shaft 405 and the drive shaft interface 414 described above, embodiments of the drive shaft 528 and the drive shaft interface 530 may provide that the drive shaft 528 is threaded to engage the corresponding threads of drive shaft interface 530, to cause the carriage 524 to transition in either direction along the length of the third-direction stage 520 in the third direction Z. Other engagement means between the drive shaft 528 and the drive shaft interface 530 within the carriage 524, such as worm gears, helical gears, other gearing means, belts and pulleys, or chains may be employed to cause the carriage 524 to transition in either direction along the length of the third-direction stage 520 in the third direction Z. FIG. 19 depicts the gripper assembly 600 with the carriage 524 removed therefrom, thus leaving only the gripper assembly 600. The gripper assembly 600 comprises a base plate 604, the base plate 604 and the carriage 524 being coupled together, such that movement of the carriage in the third direction Z also moves the gripper assembly 600 in the third direction Z.

Figure 20:
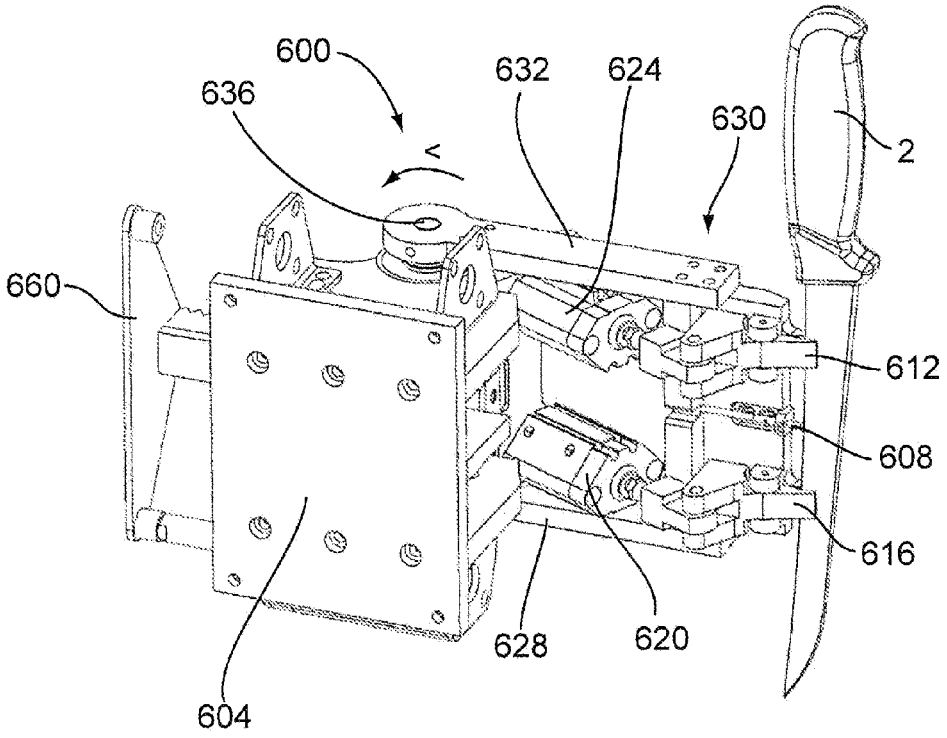
FIG. 20 is a rear perspective view of the gripper assembly of the sharpening and cleaning system in accordance with the present disclosure.

FIG. 20 depicts the gripper assembly 600. Embodiments of the system 10 include the gripper assembly 600 further comprising a gripper bracket 630 having an upper arm 632, a lower arm 628, and a gripper plate 614 positioned therebetween. The gripper bracket 630 is configured to rotate about a drive shaft 636. The gripper bracket 630 is further configured to rotate about the drive shaft 636, as indicated by the arrow <, between a retracted position, as exemplary depicted in FIG. 22, and an extended position, as exemplary depicted in FIG. 23. FIG. 20 depicts the gripper bracket in the extended position. In the extended position, the gripper bracket 630 and the gripper assembly 600 positions the knife 2 in preparation for sharpening the knife 2 against the grinding assembly 700. Accordingly, the blade of the knife 2 is exposed toward the grinding assembly 700.

Figure 21:
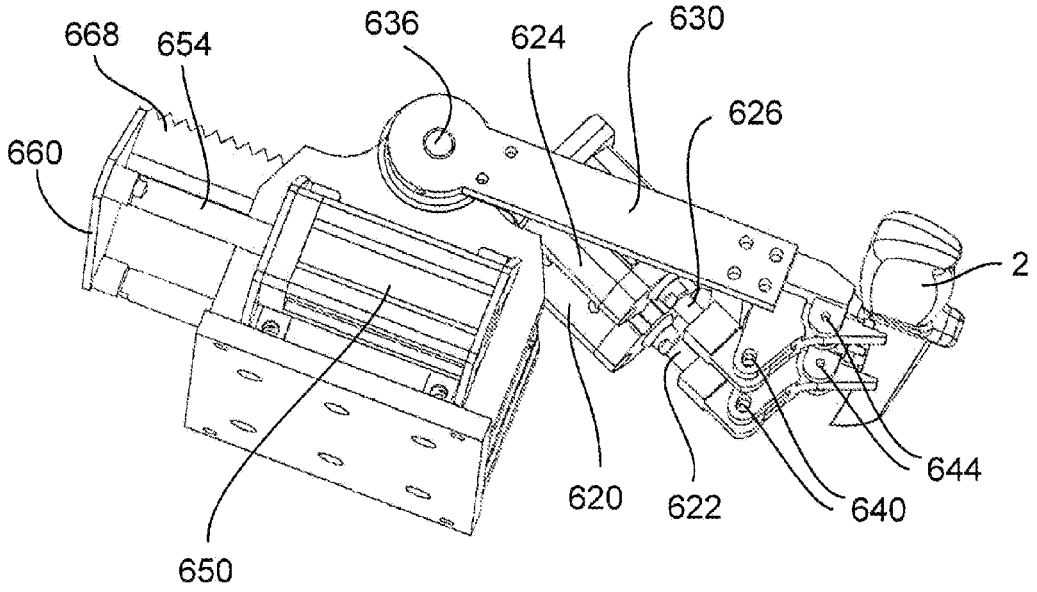
FIG. 21 is a top perspective view of the gripper assembly of the sharpening and cleaning system in accordance with the present disclosure.

FIGS. 20 and 21 depict the gripper assembly 600 further comprising a first actuator 624 and a second actuator 620. Embodiments of the gripper assembly 600 include the first and second actuators 624 and 620 being pneumatic cylinders that use compressed fluid, such as air, to provide reciprocating linear motion to a piston, the first actuator 624 having a piston 626 and the second actuator 620 having a piston 622. The first and second actuators 624 and 620 are coupled on one end to a base plate 618, which is fixedly coupled to each of the lower and upper arms 628 and 632 to prevent the base plate 618 from moving. In this way, when the first and second actuators 624 and 620 perform their intended operation, the base plate 618 holds the first and second actuators 620 and 624 in place and forces the respective pistons 626 and 622 away from the base plate 618. Coupled to the end of the piston 626 is the first knife gripper mechanism 612. Coupled to the end of the piston 622 is the second knife gripper mechanism 616. Actuation of each of the pistons 626 and 622 causes the respective first and second knife gripper mechanisms 612 and 616 to pivot about pivot points 640 and 644 to grip the knife 2 between the knife gripper mechanisms 612 and 616 and the opposing gripper plate 614. In other words, the linear motion of the pistons 626 and 622 causes the gripping of the knife 2 between the gripper plate 614 and the first knife gripper mechanism 612 and the second knife gripper mechanism 616. Once the knife 2 is gripped in the gripper assembly 600, the knife 2 is prevented from dislodging, or otherwise moving with respect to the gripper assembly 600 during operation of the system 10.

Embodiments of the gripper assembly 600 further comprise a third actuator 650 and a fourth actuator 652. (In FIG. 20, the third actuator 650 has been removed for convenience to better show the drive shaft 636 and the gripper bracket 630.) Embodiments of the gripper assembly 600 include the third and fourth actuators 650 and 652 being pneumatic cylinders that use compressed fluid, such as air, to provide reciprocating linear motion to a piston, the third actuator 650 having a piston 654 and the fourth actuator 652 having a piston 656. The third and fourth actuators 650 and 652 are coupled to respective retaining plates 658 that prevent the third and fourth actuators 650 and 652 from moving. Coupled to the end of each of the pistons 654 and 656 is the end bracket 680. In this way, when the third and fourth actuators 650 and 652 perform their intended operation, the retaining plates 658 secure the first and second actuators 620 and 624 in place and cause the respective pistons 654 and 656 to push the end bracket 680 away from the third and fourth actuators 650 and 652. Also coupled to the end bracket 680 is one end of a rack gear 668. Thus, actuation of each of the pistons 654 and 656 causes the end bracket 680 to operate the rack gear 668. Actuation of the rack gear 668 causes a pinion gear 672 to rotate and drive the drive shaft 636, which is coupled to the pinion gear 672, is held in place by the retaining plates 658, and is coupled on its distal ends to the gripper bracket 630. It follows that operation of the rack and pinion gears 668 and 652 causes the gripper bracket 630 to rotate about the drive shaft 636.

Figure 22:
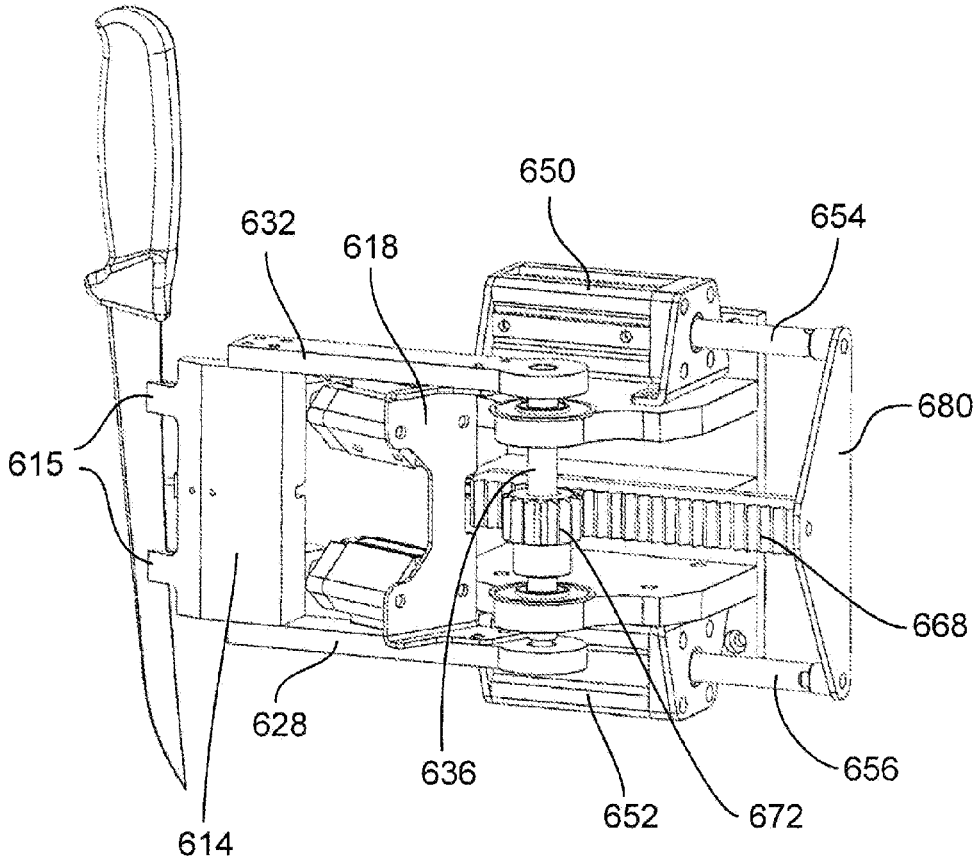
FIG. 22 is a front perspective view of the gripper assembly of the sharpening and cleaning system in accordance with the present disclosure.
Figure 23:
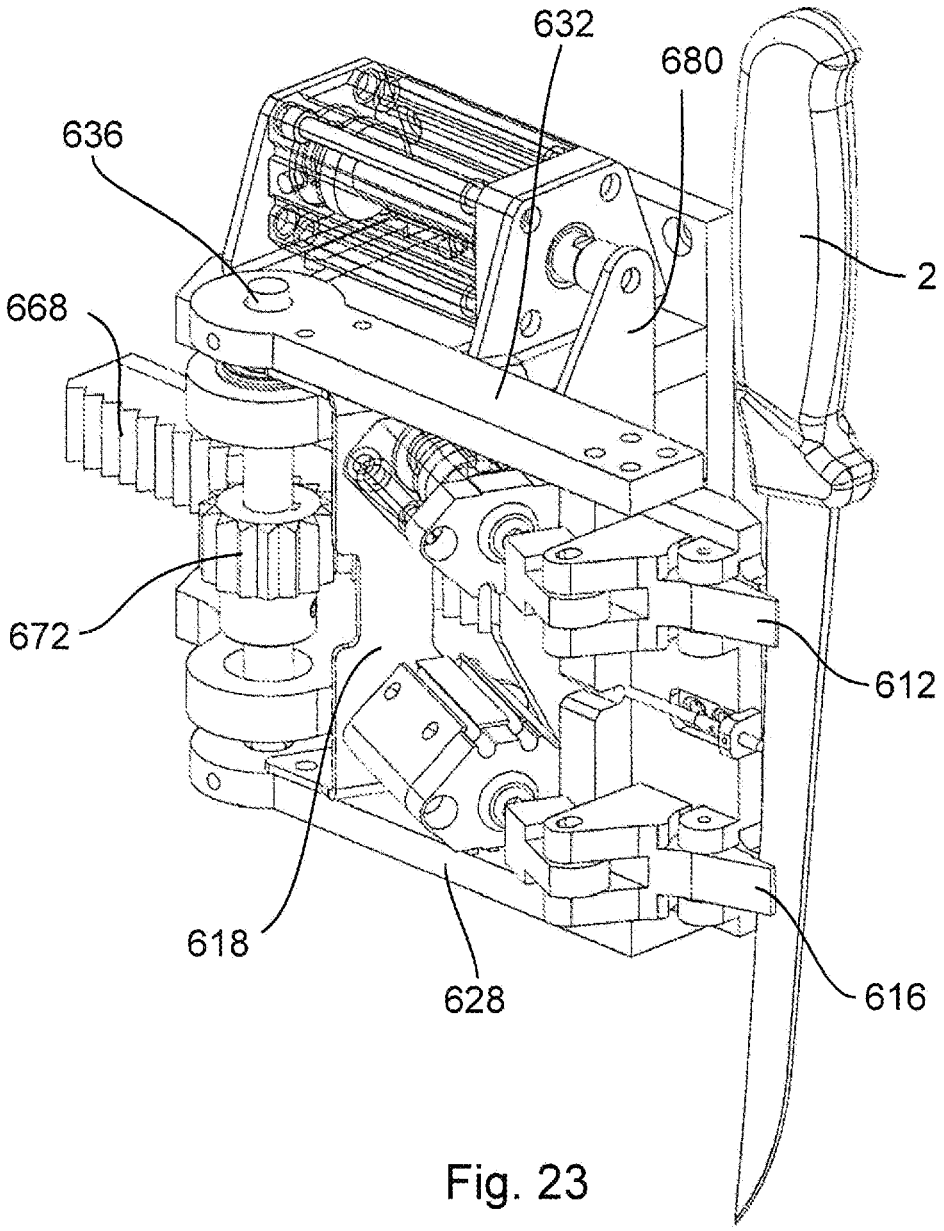
FIG. 23 is a front perspective view of the gripper assembly of the sharpening and cleaning system in accordance with the present disclosure.

As depicted in FIG. 22, under the condition that the end bracket 680 is extended away from the third and fourth actuators 650 and 652, the gripper bracket 630 is in the extended position, with the knife 2 prepared for sharpening against the grinding assembly 700. On the other hand, as depicted in FIG. 23, under the condition that the end bracket 680 is retracted toward the third and fourth actuators 650 and 652, the gripper bracket 630 is in the retracted position, with the knife 2 prepared to be replaced in its position in one of the various knife holder trays 200. Further depicted in FIG. 23, the first and third actuators 624 and 650 are transparent to display their inner workings.

Operation of the first and second actuators 624 and 620 cause the knife 2 to be gripped in the gripper assembly 600, as described above, whereas operation of the third and fourth actuators 650 and 652 cause the gripper bracket 630 to rotate about the shaft 636 between the retracted and the extended positions. Each of the first, second, third, and fourth actuators 624, 620, 650, and 652 may be monitored in real-time to determine whether the actuators 624, 620, 650, and 652 are functioning properly. Also, each of the first, second, third, and fourth actuators 624, 620, 650, and 652 may have limits set thereon, so that each of their respective pistons only travels a predetermined distance. Also, each of the first, second, third, and fourth actuators 624, 620, 650, and 652 have compressed air provided thereto for operation. In the retracted position, the gripper assembly 600 is prepared to grip and remove a knife 2 from any of the trays 200. Once gripped, the gripper assembly may rotate to the extended position to prepare the knife for sharpening by the grinding assembly 700, as depicted in FIG. 23. Once the grinding is complete, the gripper assembly may be rotated back to the retracted position and place the knife 2 back in the tray 200 from which it was removed.

Embodiments of the gripper assembly 600 further comprise a knife position sensor 608 positioned in and secured by the opposing gripper plate 614. The knife position sensor 608 may be a digital sensor. The knife position sensor 608 may be a laser sensor. The knife position sensor 608 is configured to detect the spine edge of each knife 2 as the gripper assembly 600 searches for knives 2 in the trays 200. Once the knife position sensor 608 detects a knife 2 in the tray 200, the gripping assembly 600 grips the knife 2 and processes the knife 2 through the system 10, as described above. Moreover, the control box 60 tracks the position of the gripper bracket 30 within the three-dimensional space within the system 10, thus permitting the control box 60 to remember the position of each knife 2 in its respective tray 200 from which it was removed. Thus, each knife 2 may be removed, processed by the system 10, and replaced in the same tray 200 from which it was previously removed. In addition to the above, the knife position sensor 608 ensures that the gripper assembly 600 centers the spine of the knife 2 between the opposing gripper plate 614 and the first and second knife gripper mechanisms 612 and 616 prior to the knife 2 being gripped, so that the knife 2 can be securely gripped between the opposing gripper plate 614 and the first and second knife gripper mechanisms 612 and 616 once the first and second actuators 624 and 620 are actuated. The knife position sensor 608 also detects the presence of a knife 2 in the tray 200. If no knife is present FIGS. 25-30 depict a grinding assembly 700. Embodiments of the system 10 include the grinding assembly 700 comprising an angle bracket 720, a support beam 716, a mount 718, a grinding station plate 744, a grinding wheel motor 740, and a motor/gear box 742. The angle bracket 720 is configured to couple to a portion of the inner frame 38 to secure and fix the grinding assembly 700 to the inner frame 38. The support beam 719 is configured to couple to the angle bracket 720. The support beam 719 is configured to space the grinding wheels 724 and 732 a distance away from the frame 38 in the 3D space of the system 10 to provide ample room for the grinding assembly 700 to sharpen and process the knives 2. Embodiments of the grinding assembly 700 include the grinding assembly 700 having more than one angle bracket 720 and more than one support beam 716. In particular, the grinding assembly 700 may include two angle brackets 720 and two corresponding support beams 716, one angle bracket 720 and one support beam 716 on either side of the grinding assembly 700. On a distal end of the support beam 716, a mount 718 may be coupled to the support beam 716. Embodiments of the grinding assembly 700 include the angle bracket 720, the support beam 716 and the mount 718 being formed of a single piece.

The mount 718 is configured to provide a platform, or a base, about which the grinding station 702 is configured to rotate. On each side of the grinding station 702, a grinding station plate 744 couples the grinding station 702 to the corresponding mounts 718 on each support beam 716. The mount 718 can be configured with a bore in a central portion thereof. A corresponding bore can be found in each of the grinding station plates 744. The bore in the mount 718 and the corresponding bore in the grinding station plate 744 are configured to align along a common rotational axis 746. The motor 740 may be mounted to one of the grinding station plates 744. The drive shaft of the motor 740 is coupled to a gear mechanism 741 that drives the grinding wheel drive shaft 754, to be described in greater detail below. The motor 740 may be an electric motor.

The motor/gear box 742 may be mounted on the mount 718 such that a drive shaft of the motor/gear box 742 is axially aligned with the common rotational axis 746. The motor/gear box 742 can provide bi-directional rotational displacement to cause the grinding station plate 744 to rotate about the common rotational axis 746. In other words, the configuration of the motor/gear box 742 allows the motor/gear box 742 to drive the rotation of the grinding station 702 about the common rotational axis 746, as indicated by the arrow in FIG. 26. The motor/gear box 742 can be an industrial motor/gear box, for example the motor/gear box, serial number GBPH-060x-NS, provided by Anaheim Automation.

Embodiments of the system 10 include the grinding station 702 further comprising a grinding wheel stage 708 functionally positioned between opposing grinding station plates 744, grinding wheel holders 712 functionally and slidably coupled to the grinding wheel stage 708, and a stage drive motor 704. The grinding wheel stage 708 is configured to traverse the gap between opposing grinding station plates 744. The grinding wheel stage 708 is further configured to receive and slidably engage one or more grinding wheel holders 712 thereon. The grinding wheel holders 712 are configured to support the various grinding wheels 724 and 732 thereon, under the grinding wheel stage 708. The stage drive motor 704 is configured to provide bidirectional rotational displacement of a stage drive shaft 706. The stage drive shaft 706 connects to the motor 704, is driven by the motor 704, and functionally engages each of the grinding wheel holders 712. Each of the grinding wheel holders 712 further comprises a drive shaft interface 713, similar to the drive shaft interfaces 414 and 530 described above. In other words, the stage drive shaft 706 may be configured to engage a drive shaft interface 713 on each of the grinding wheel holders 712 to displace the grinding wheel holders 712 along the length of the grinding wheel stage 708. In this way, each of the grinding wheel holders 712 can be individually displaced along the grinding wheel stage 708, as determined by the system 10.

Further, the drive shaft interfaces 713 of the respective grinding stones 732 may be counter oriented, such that rotation of the stage drive shaft 706 causes the grinding stones 732 to displace further apart or closer together, depending on the rotational direction of the stage drive shaft 706, as determined by the drive shaft motor 704 and the control box 60. Similarly, the drive shaft interfaces 713 of the respective honing stones 724 may be counter-oriented, such that rotation of the stage drive shaft 706 causes the honing stones 724 to displace either further apart or closer together, depending on the rotational direction of the stage drive shaft 706, as determined by the drive shaft motor 704 and the control box 60. For example, embodiments of the stage drive shaft 706 may provide that the shaft 706 is threaded to engage the corresponding threads of the corresponding drive-shaft interface 713. The threads of the drive shaft interface 713 in each of the grinding stones 732 may be counter-oriented such that rotation of the drive shaft 706 in one direction causes one of the grinding stones 732 to move in one direction whereas the corresponding grinding stone moves in the opposing direction. Thus, by rotating the drive shaft 706, the grinding stones are moved either closer together or further apart. The same configuration may be applied to the honing stones 724. By allowing the stones 724 and 732 to move closer together or further apart, as needed, provides that the stones 724 and 732 can be adjusted in real-time according to the feedback provided by the various sensors within the system 10, and in particular by the feedback provided by the touch plate sensor 534 and a knife position sensor 762, to be discussed below. Real-time adjustment of the stones 724 and 732 provides that each individual knife 2 can receive a custom, or otherwise individual, processing by the system 10.

Embodiments of the system 10 include the grinding station 702 further comprising a grinding wheel bracket 714 coupled to each of the grinding wheel holders 712. The grinding wheel bracket 714 may be configured to hold a grinding wheel 724 or 732 therein. The grinding wheel bracket 714 may be configured to functionally engage a distal end of a grinding wheel spinning shaft 750. The opposing distal end of the grinding wheel spinning shaft 750 may be functionally engaged by the underside of the corresponding grinding wheel holder 712. Thus, the grinding wheel spinning shaft 750 is supported under the grinding wheel stage 708 between the grinding wheel holder 712 and the grinding wheel bracket 714. Each grinding wheel spinning shaft 750 has coupled thereto a grinding wheel, either 724 or 732. Thus, as the grinding wheel spinning shaft 750 rotates, the corresponding grinding wheel, either 724 or 732 also rotates. The grinding wheel spinning shaft 750 rotates in response to the rotation of the grinding wheel drive shaft 754 that receives rotary motion from the motor 740. As the motor 740 drives the drive shaft 754, a drive shaft gear 756 coupled to the drive shaft 754 also rotates. One drive shaft gear 756 is positioned on the drive shaft 754 near each of the grinding wheel spinning shafts 750. Coupled to each of the grinding wheel spinning shafts 750 is a spinning shaft gear 758 that corresponds to the drive shaft gear 756. The drive shaft gear 756 functionally engages the spinning shaft gear 758. The drive shaft gears 756 have an axial length that is wider than the diameter width of the spinning shaft gears 758 to allow the spinning shaft gears 758 to remain functionally engaged to the drive shaft gears 756 even when the grinding wheel holders 712 are displaced along the grinding wheel stage 708. Accordingly, as the motor 740 rotates, the rotational motion is translated to the drive shaft 754 that rotates each of the drive shaft gears coupled thereto, which causes the corresponding spinning shaft gears 758 to rotate, which causes the grinding wheels 724 or 732 coupled thereto to also rotate. The rotational motion of the grinding wheels 724 and 732 allows the knives 2 to be sharpened thereby.

Embodiments of the system 10 include the grinding station 702 further comprising a knife position sensor 762. The knife position sensor 762 may be coupled to the grinding station 702 to allow the knife position sensor 762 to sense the position of the knife 2 during the grinding and sharpening process. As depicted, the knife position sensor 762 is positioned on either side of the grinding station 702. The knife position sensors 762 may be digital sensors that are light-based sensors, such as a laser sensor, or may be any sensor that is capable of sensing the profile of an object placed therebetween. The knife position sensors 762 are positioned at a location on the grinding station 702 to allow the knife 2 to be sensed, and the profile of the knife to be sensed. While sensing the profile of the knife 2, the grinding station holders 712 may be moved along the grinding station stage 708, as needed, to accommodate for the individual profile of the knife 2. Moreover, as mentioned above, the grinding station 702 may pivot about the axis 746, as needed, to accommodate for the individual profile of the knife 2. Thus, as the entire blade of the knife 2 is engaged by the stones 724 and 732, the entire grinding station 702 may pivot to keep the grinding stones 724 and 732 perpendicular to the curvature of the blade of the knife 2. Thus, the sensors 762 provide real-time feedback to the control box 60 which instructs the motor/gear box 742 to pivot the grinding station 702 to maintain the grinding wheels 724 and 732 perpendicular to the curvature of the blade of the knife 2 during sharpening of the entire blade. Real-time adjustment of the pivot of the grinding station 702 and thus the orientation of the stones 724 and 732 provides that each individual knife 2 can receive a custom, or otherwise individual, processing by the system 10.

Embodiments of the system 10 include the grinding assembly 700 accommodating different grinding stones. For example, grinding stones 724 may be honing stones. Further in example, grinding stones 732 may be grinding stones. Thus, the knife 2 may receive an initial sharpening or shaping against the grinding stones 732 and thereafter may receive a finer honing of its edge against the honing stones 724. In addition the grinding station 702 further comprises steeling rods 758 coupled to the grinding station 702. The system 10 may be programmed to move the knife 2 along the steeling rods 758 to help maintain the sharpness of the blade of the knife 2. The system 10 may be programmed to utilize one or all of the grinding stones 724 and 732 and the steeling rods 758, in any order desired by the user, as needed. Again, the sensors 762 direct the system 10 in steeling the knife 2 against the steeling rods 758.

Figure 24:
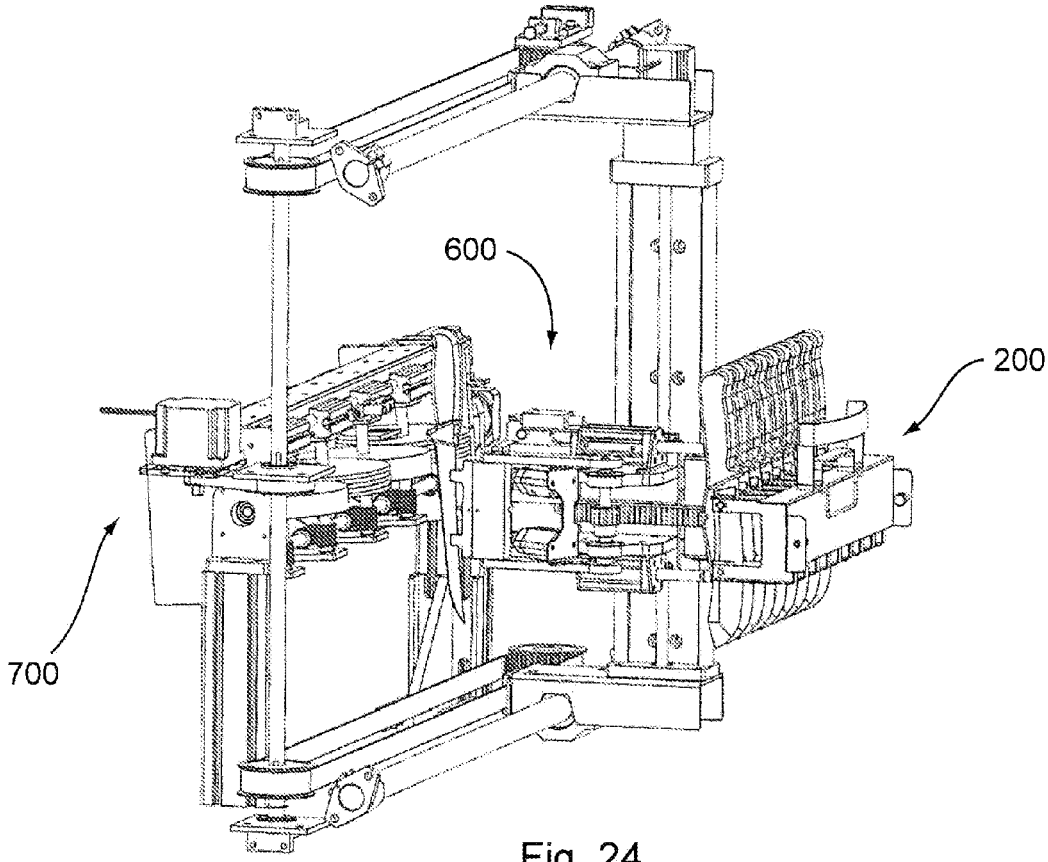
FIG. 24 is a front perspective view of several internal components of the sharpening and cleaning system in accordance with the present disclosure.
Figure 25:
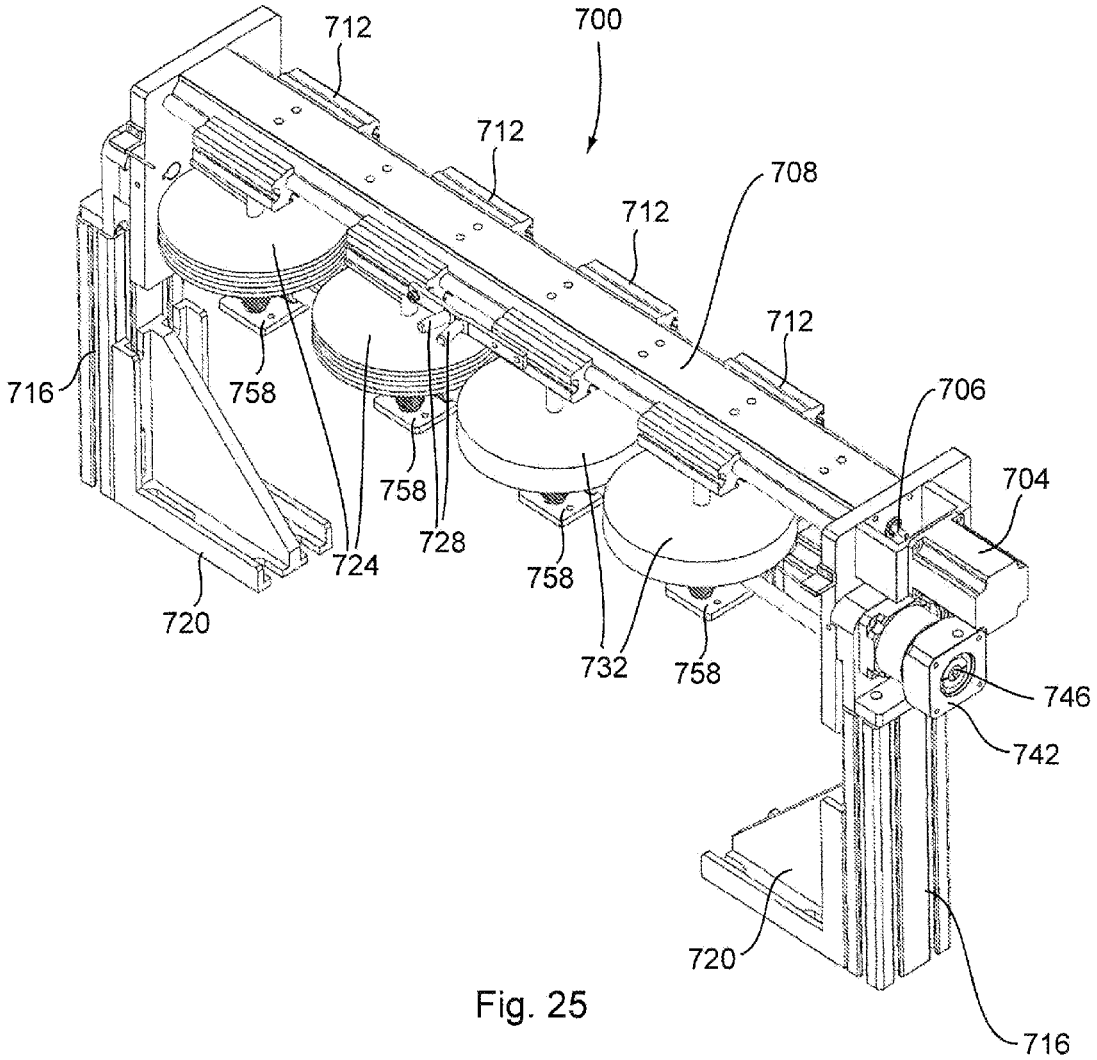
FIG. 25 is a front perspective view of a sharpening assembly of the sharpening and cleaning system in accordance with the present disclosure.
Figure 26:
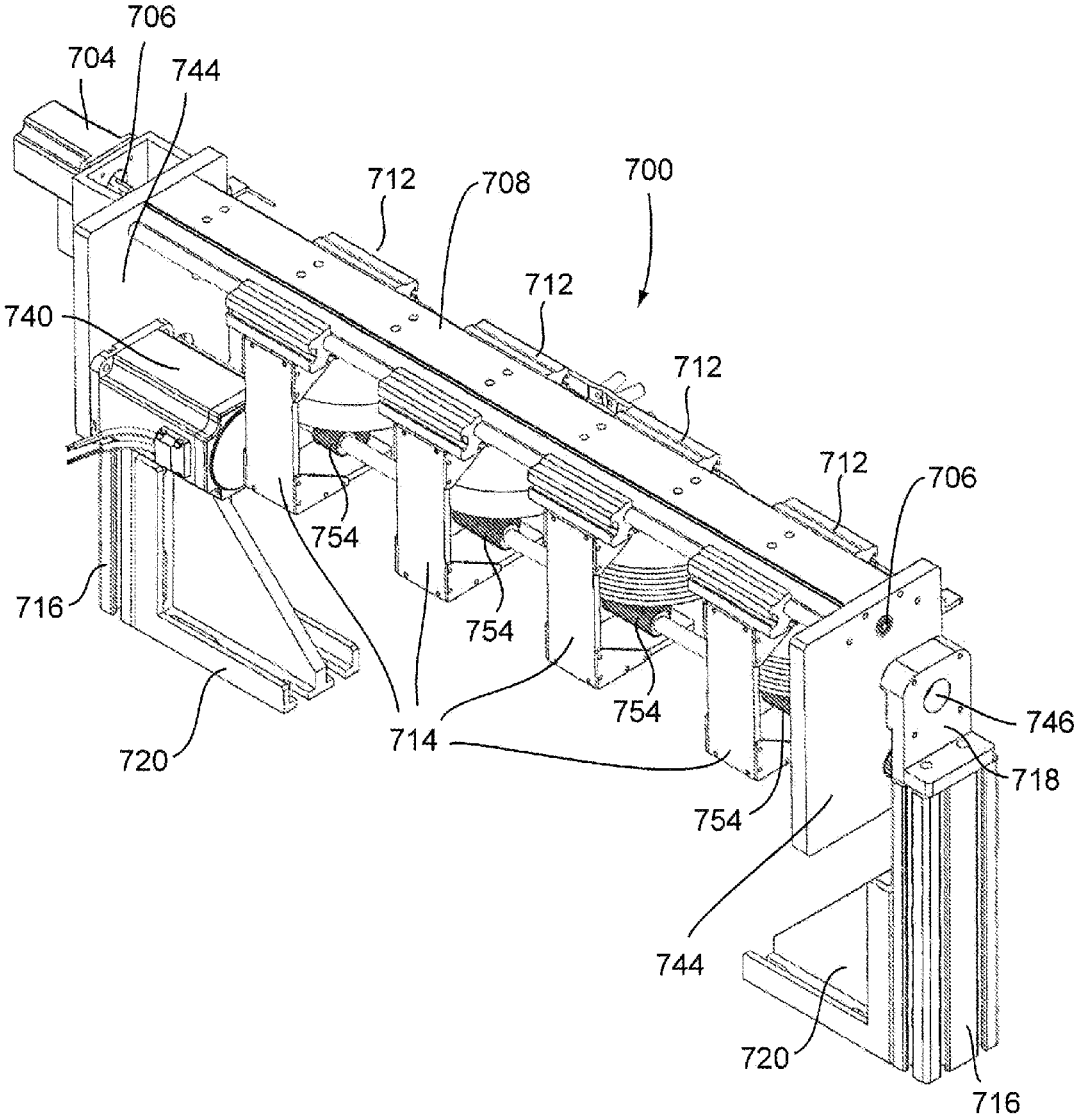
FIG. 26 is a rear perspective view of the sharpening assembly of the sharpening and cleaning system in accordance with the present disclosure.
Figure 27:
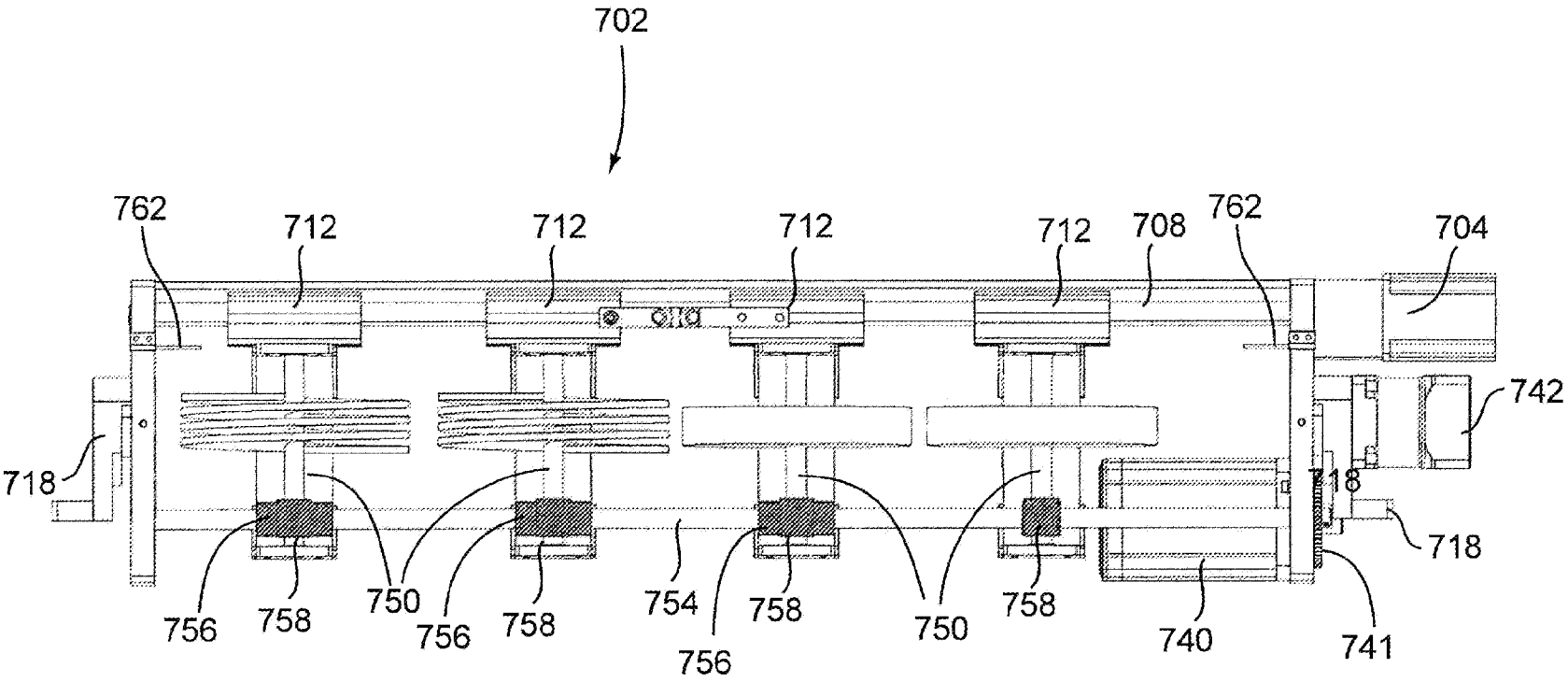
FIG. 27 is a front view of the sharpening assembly of the sharpening and cleaning system in accordance with the present disclosure.
Figure 28:
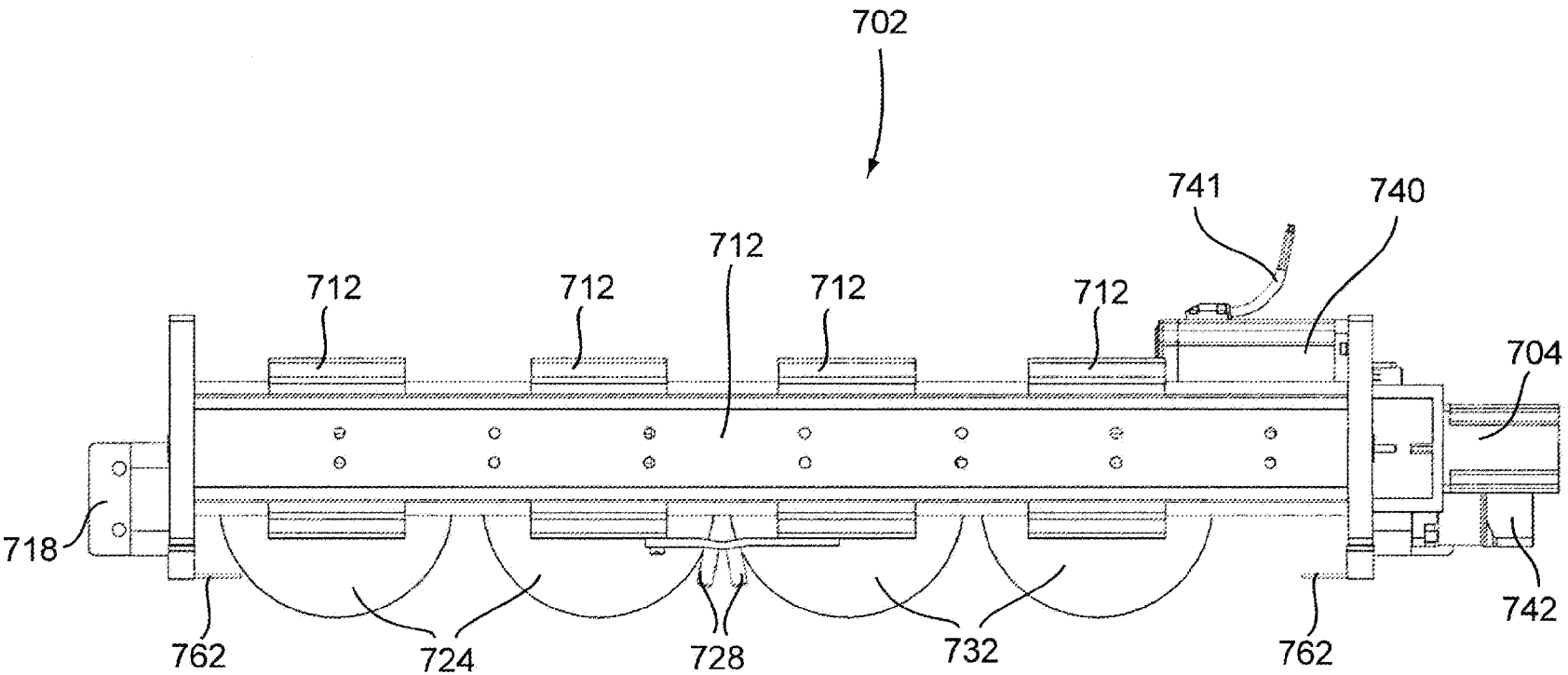
FIG. 28 is a top view of the sharpening assembly of the sharpening and cleaning system in accordance with the present disclosure.
Figure 29:
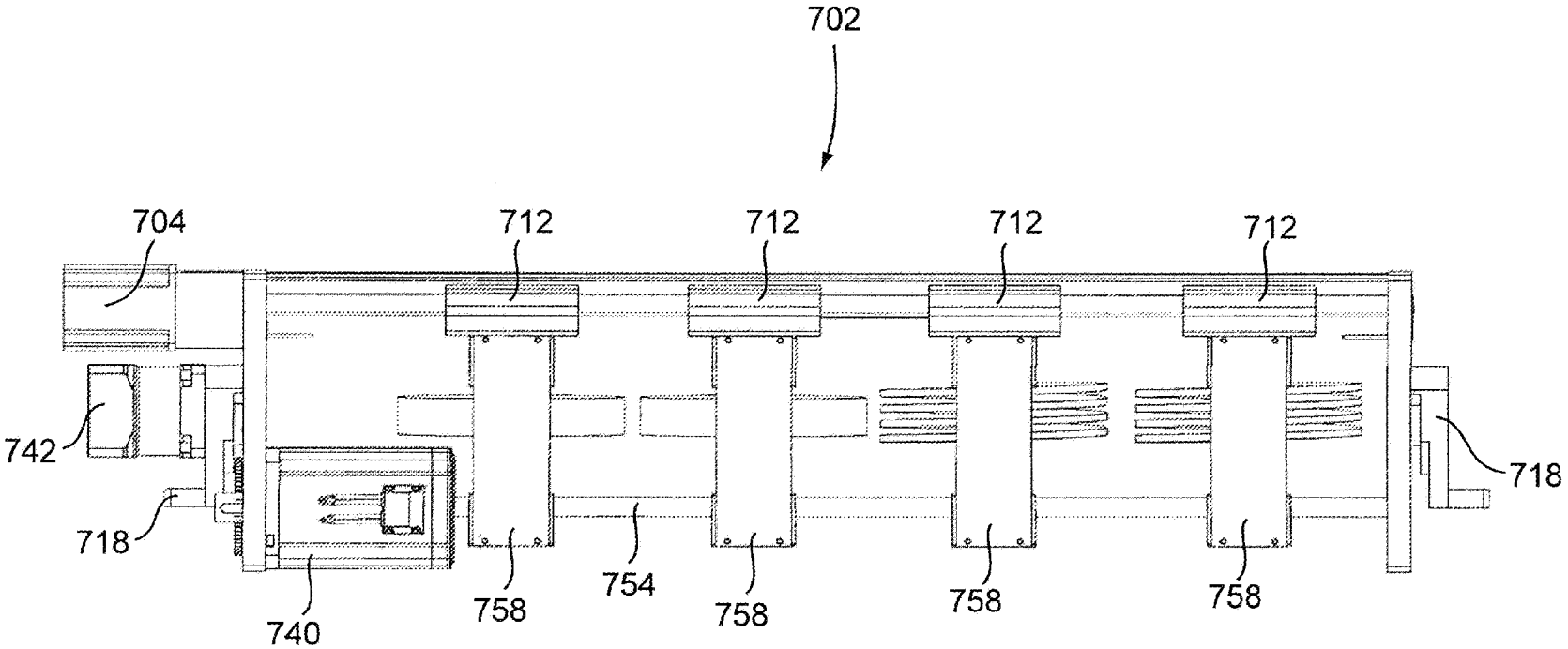
FIG. 29 is a rear view of the sharpening assembly of the sharpening and cleaning system in accordance with the present disclosure.
Figure 30:
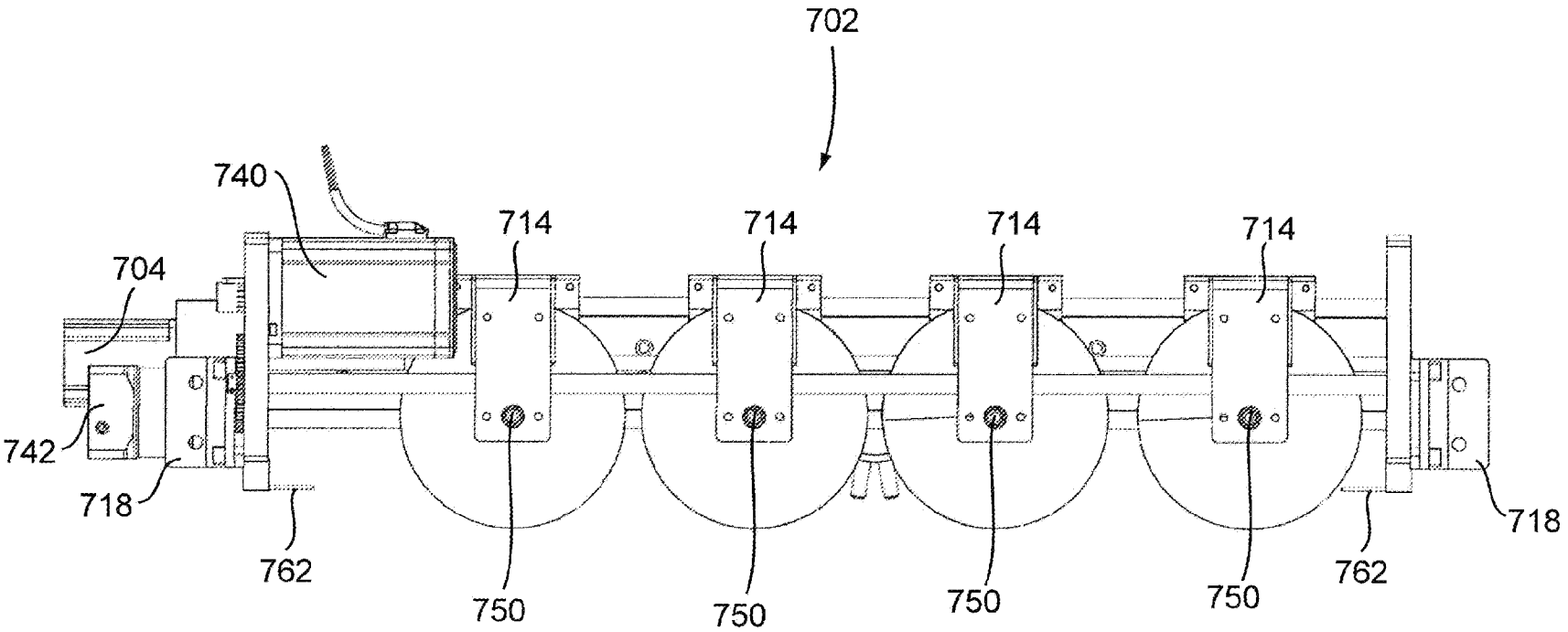
FIG. 30 is a bottom view of the sharpening assembly of the sharpening and cleaning system in accordance with the present disclosure.

Referring again to the Figures, and with reference to the description above, a method of using the system 10 will be further described. The knife 2, shown in FIG. 24, is being gripped by the gripper assembly 600, the gripper assembly 600 being in the extended position and ready to place the knife 2 between the sensors 762 to be processed within the grinding assembly 700. Prior to the knife 2 being gripped by the gripper assembly 600, the knife 2 was placed in one of the trays 200. After the tray 200 has been placed within the system 10, the system 10 is ready to process the knife 2. Once activated by the user, the system 10 instructs the first direction drive assembly 300, the second-direction drive assembly 400 and the third-direction drive assembly 500 to move the gripper assembly 600 within the 3D space of the system 10 toward the trays 200. The system 10 may then activate a cleaning process, wherein hot water is sprayed onto the knives 2 through the spray nozzles 584 to clean the knives 2 that may have meat residue thereon. Once clean, the system can instruct the gripper assembly 600 to grip one of the knives 2 in the tray. Thus, the gripper assembly 600 is moved to the tray 200, the knife position sensor 608 detects the spine of the knife 2. Once aligned, according to the feedback provided by the knife position sensor 608, the gripper assembly 600 grips the knife 2 and removes it from the tray 200. The first and second actuators 624 and 620 cause the gripper assembly 600 to grip the knife. Thereafter, the third and fourth actuators 650 and 652 cause the gripper assembly bracket 630 to pivot, with the knife therein, from the retracted position to the extended position. The system 10 then instructs the first direction drive assembly 300, the second-direction drive assembly 400 and the third-direction drive assembly 500 to move the gripper assembly 600 with the knife 2 therein to the grinding assembly 700. The profile of the knife 2 is sensed by the sensors 762. The grinding station 702 is adjusted according to the feedback provided by the sensors 762 regarding the profile of the knife 2, and the position of the knife 2 is adjusted within the 3D space of the system by the first direction drive assembly 300, the second-direction drive assembly 400, and the third-direction drive assembly 500 according to the feedback provided by the sensors 762. Once the knife 2 is properly sharpened by the grinding assembly 700, using the grinding stones 724 and 732 and the steeling rods 728 as described in detail above, the gripper assembly 600 pivots the gripper assembly bracket 630 to pivot to the retracted position with the knife 2 therein. In the retracted position, the first direction drive assembly 300, the second-direction drive assembly 400, and the third-direction drive assembly 500 can move the gripper assembly 600 in the 3D space of the system 10 to return the knife 2 back to the tray 200 from which it was removed. Once replaced, the system 10 processes the next knife 2. After processing the knives 2 in each of the trays 200, the system 10 can instruct the spray nozzles 584 to spray a cleaning solution, either hot rinse water or soapy water, followed by a sanitizing solution on each of the knives 2 to clean and sanitize the knives 2 prior to the knives 2 being used by the meat cutters. In this way, each knife 2 placed within a tray 200 in the system 10 receives an automated, efficient, convenient, custom cleaning, sharpening, and sanitizing.

All of the above-described components are rated for mild wash-down environments. The fluid collector 46 is configured to collect any fluid that is used during the operation of the system, and the drain 48 carries the fluid away from the system 10, such that there is no fluid build-up within the system 10. However, the system 10 may be configured to monitor the build-up of fluids within the system 10. The system 10 may be configured to shut-down should fluid build-up prevent safe operation of the system 10.

Any of the motors described above within the system 10 may be configured to provide rotational movement in multiple directions. In other words, the motors can be configured to provide clockwise or counter-clockwise rotational displacement of a driveshaft. Also, any of the motors described above within the system 10 may be stepper motors that provide reliable and repeatable motion. Any of the motors may also be configured to provide rotational movement in multiple directions any of the motors described above within the system 10 may be digitally monitored in real-time by sensors that communicate with the control box 60, the motors providing digital input to the control box 60 to inform the control box 60 of the current operational status of the individual motor. Any of the actuators described above within the system may be configured to be digitally monitored in real-time by sensors that communicate with the control box 60, the actuators providing digital input to the control box 60 to inform the control box 60 of the current operational status of the individual actuator. The air-pressure of each of the actuators may be measured by digital sensors and provided to the control box 60. Also, the cylinder piston displacement limits of the actuators may further be monitored by sensors and reported to the control box 60. The water temperature of the system 10 in any of the fluid lines may also be monitored by a thermometer to provide real-time input to the control box 60 to inform the control box 60 of the current water temperature. Should any of these devices or system features fail or should these devices fall below or rise above predetermined limits, the system 10 may be programmed to shut down, exclude one or more operations, or continue operation, depending on the gravity of the information received by the control box 60. The current status of the system 10 can be displayed on any of the digital outputs to be seen by the user.

Any of the above-described parts may be replaceable without having to replace the entire system 10. Individual parts that malfunction or become damaged or worn may be replaced.

The components of the system 10 may be formed of any of many different types of materials or combinations thereof that can readily be formed into shaped objects provided that the components selected are consistent with the intended operation of the system 10. For example, the components may be formed of: rubbers (synthetic and/or natural) and/or other like materials; glasses (such as fiberglass) carbon-fiber, aramidfiber, any combination thereof, and/or other like materials; polymers such as thermoplastics (such as ABS, Fluoropolymers, Polyacetal, Polyamide; Polycarbonate, Polyethylene, Polysulfone, and/or the like), thermosets (such as Epoxy, Phenolic Resin, Polyimide, Polyurethane, Silicone, and/or the like), any combination thereof, and/or other like materials; composites and/or other like materials; metals, such as zinc, magnesium, titanium, copper, iron, steel, carbon steel, alloy steel, tool steel, stainless steel, aluminum, any combination thereof, and/or other like materials; alloys, such as aluminum alloy, titanium alloy, magnesium alloy, copper alloy, any combination thereof, and/or other like materials; any other suitable material; and/or any combination thereof.

Furthermore, the components defining the system 10 may be purchased pre-manufactured or manufactured separately and then assembled together. However, any or all of the components may be manufactured simultaneously and integrally joined with one another. Manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled with one another in any manner, such as with adhesive, a weld, a fastener (e.g. a bolt, a nut, a screw, a nail, a rivet, a pin, and/or the like), wiring, any combination thereof, and/or the like for example, depending on, among other considerations, the particular material forming the components. Other possible steps might include sand blasting, polishing, powder coating, zinc plating, anodizing, hard anodizing, and/or painting the components for example.

While this disclosure has been described in conjunction with the specific embodiments outlined above, it is evident that many alternatives, modifications and variations will be apparent to those skilled in the art. Accordingly, the preferred embodiments of the present disclosure as set forth above are intended to be illustrative, not limiting. Various changes may be made without departing from the spirit and scope of the present disclosure, as required by the following claims. The claims provide the scope of the coverage of the present disclosure and should not be limited to the specific examples provided herein.

What is claimed is:

1. An automated utensil sharpening and cleaning system, said system comprising:

a container body;

a utensil holder, said utensil holder being configured to be releasably coupled to said container body, said utensil holder being configured to hold a utensil adapted to hold a plurality of utensils;

a drive assembly;

a gripper assembly, said gripper assembly being coupled to said drive assembly said drive assembly being configured to move the adopted to move said gripper assembly in three-dimensions within said container body; and a grinding assembly, said grinding assembly being configured adapted to sharpen the utensil one of said plurality of utensils, wherein said gripper assembly is configured adapted to grip the utensil one of said plurality of utensils and remove the utensil said one of said plurality of utensils from said utensil holder, hold said one utensil within said grinding assembly during sharpening, and place and release said one utensil in said utensil holder once said sharpening is complete;

wherein said drive assembly comprises;

a first-direction drive assembly that is configured to move said gripper assembly in a first direction;

a second-direction drive assembly that is configured to move said gripper assembly in a first direction; and a third-direction drive assembly that is configured to move said gripper assembly in a first direction, wherein said gripper assembly is coupled to said third-direction drive assembly, said third-direction drive assembly is coupled to said second-direction drive assembly, said second-direction drive assembly is coupled to said first-direction drive assembly, and said first-direction drive assembly is coupled to an internal frame in said container body;

a control unit;

a water supply;

a sanitizing agent;

spray nozzles; and a mixer/injector, said mixer/injector being in fluidic communication with said water supply, said sanitizing agent and said spray nozzles, wherein said control unit is configured to instruct said mixer/injector to spray water from said spray nozzles onto said one of said plurality of utensils prior to said gripper assembly gripping said one of said plurality of utensils, and wherein said control unit is configured to instruct said mixer/injector to spray a mixture of said water and said sanitizing agent onto said one of said plurality of utensils after the gripper assembly has released said one of said plurality of utensils.

2. A method of renewing a utensil, the method comprising:

inserting a utensil in a utensil holder in a container body;

gripping said utensil in a gripper assembly positioned in said container body and coupled to a drive assembly configured to move said gripper assembly in three dimensions within said container body;

removing said utensil from the utensil holder by operation of said gripper assembly;

moving the gripper assembly within the container body to position said utensil near a grinding assembly within said container body;

sharpening said utensil with said grinding assembly;

moving said gripper assembly within said container body to replace said utensil in said utensil holder, wherein said drive assembly comprises:

a first-direction drive assembly that is configured to move said gripper assembly in a first direction;

a second-direction drive assembly that is configured to move said gripper assembly in a first direction; and a third-direction drive assembly that is configured to move said gripper assembly in a first direction, wherein the gripper assembly is coupled to said third-direction drive assembly, said third-direction drive assembly is coupled to said second-direction drive assembly, said second-direction drive assembly is coupled to said first-direction drive assembly, and said first-direction drive assembly is coupled to an internal frame in said container body;

spraying heated water onto said utensil prior to removal of said utensil from said utensil holder; and spraying a mixture of water and sanitizing solution onto said utensil after replacement of said utensil in said utensil holder.

3. The method of claim 2 further comprising:

using sensors to detect a position of said utensil in said utensil holder;

communicating said sensed position to a control unit;

controlling the operation of said gripper assembly from said sensed position communicated to said control unit.

4. The method of claim 2 further comprising:

using sensors to detect a position of said utensil near said grinding assembly;

using sensors to detect an entire profile of a blade of said utensil;

communicating said entire profile to a control unit;

sharpening said blade of said utensil against a grinding stone in a grinding station said grinding assembly;

instructing said grinding station to pivot said grinding station so as to maintain a perpendicular orientation of said grinding stone with respect to said profile of said blade.

* * * * *